US009778597B2

(12) United States Patent
Eto

(10) Patent No.: US 9,778,597 B2
(45) Date of Patent: Oct. 3, 2017

(54) IMAGE FORMING APPARATUS

(71) Applicant: KYOCERA Document Solutions Inc., Osaka-shi, Osaka (JP)

(72) Inventor: Daisuke Eto, Osaka (JP)

(73) Assignee: KYOCERA DOCUMENT SOLUTIONS INC., Osaka-shi, Osaka (JP)

( * ) Notice: Subject to any disclaimer, the term of this patent is extended or adjusted under 35 U.S.C. 154(b) by 0 days.

(21) Appl. No.: 15/255,186

(22) Filed: Sep. 2, 2016

(65) Prior Publication Data

US 2017/0075258 A1 Mar. 16, 2017

(30) Foreign Application Priority Data

Sep. 10, 2015 (JP) ..... 2015-178274

(51) Int. Cl.
*G03G 15/08* (2006.01)
*G03G 21/16* (2006.01)

(52) U.S. Cl.
CPC ..... *G03G 15/0889* (2013.01); *G03G 21/1633* (2013.01); *G03G 21/1676* (2013.01); *G03G 15/0865* (2013.01)

(58) Field of Classification Search
CPC ..... G03G 15/08; G03G 15/0822; G03G 15/0889; G03G 15/0896; G03G 21/1839; G03G 21/1842; G03G 21/1846; G03G 21/185; G03G 21/1853; G03G 15/0865; G03G 21/1633; G03G 21/1676
See application file for complete search history.

(56) References Cited

U.S. PATENT DOCUMENTS

2007/0071496 A1* 3/2007 Lee ..... G03G 21/1853 399/111
2012/0275820 A1 11/2012 Eto

FOREIGN PATENT DOCUMENTS

JP 2012-230280 11/2012

* cited by examiner

*Primary Examiner* — Hoang Ngo
(74) *Attorney, Agent, or Firm* — Gerald E. Hespos; Michael J. Porco; Matthew T. Hespos

(57) ABSTRACT

An image forming apparatus includes an apparatus body, an image carrier, a developing device, and a developer container. The developing device includes a developer supply port and a mounting section. The developing device is mounted onto a developing position facing the image carrier through a specific insertion path in the apparatus body. The developer container includes a developer discharge port. The developer container is mounted onto the mounting section of the developing device through the insertion path. The developing device is dismounted from the apparatus body through the insertion path after being rotated from the developing position to a standby position in a first direction around a first axis extending in parallel with a rotary axis of the image carrier. The developer container is dismounted from the apparatus body after being rotated in a second direction opposite to the first direction around a second axis in the mounting section.

6 Claims, 31 Drawing Sheets

IMAGE FORMING APPARATUS

INCORPORATION BY REFERENCE

This application is based on Japanese Patent Application No. 2015-178274 filed with the Japan Patent Office on Sep. 10, 2015, the contents of which are hereby incorporated by reference.

BACKGROUND

The present disclosure relates to an image forming apparatus configured to form an image on a sheet.

Conventionally, image forming apparatuses configured to form an image on a sheet are known which include an apparatus body, a photoconductive drum (image carrier), a developing device, and a developer container. The developing device supplies developer to the photoconductive drum. Consequently, an electrostatic latent image formed on the photoconductive drum is developed. The developer container supplies developer to the developing device.

Further, there is known a technique for configuring the developer container to be mounted in and dismounted from the apparatus body. In such technique, a cover member of the apparatus body is opened to allow mounting of the developer container into the apparatus body. A developer discharge port of the developer container is brought into communication with a developer supply port of the developing device to supply developer to the developing device. Further, there is also known a technique for configuring the developing device to be mounted in and dismounted from the apparatus body of the image forming apparatus.

SUMMARY

An image forming apparatus according to an aspect of the present disclosure includes an apparatus body, an image carrier, a developing device, and a developer container. The apparatus body includes an openable cover member and an internal space. The image carrier is rotatably disposed in the apparatus body and has a circumferential surface for allowing an electrostatic latent image to be formed thereon. The developing device includes a developer supply port for receiving supplied developer, and a mounting section. The developing device is mounted, in an open state of the cover member, onto a developing position facing the image carrier through a specific insertion path in the internal space, and supplies the developer to the image carrier. The developer container includes a developer discharge port for discharging the developer. The developer container is mounted, in the open state of the cover member, onto the mounting section of the developing device through the insertion path, and contains the developer. The developing device is dismounted from the apparatus body through the insertion path after being rotated, in the open state of the cover member, from the developing position to a standby position in a first direction around a first axis extending in parallel with a rotary axis of the image carrier. The developer container is disengaged from the developing device and dismounted from the apparatus body through the insertion path after being rotated, in a state that the cover member is open and the developing device is at the developing position or the standby position, in a second direction opposite to the first direction around a second axis extending in parallel with the first axis in the mounting section.

These and other objects, features and advantages of the present disclosure will become more apparent upon reading the following detailed description along with the accompanying drawings.

DETAILED DESCRIPTION

Figure 1:
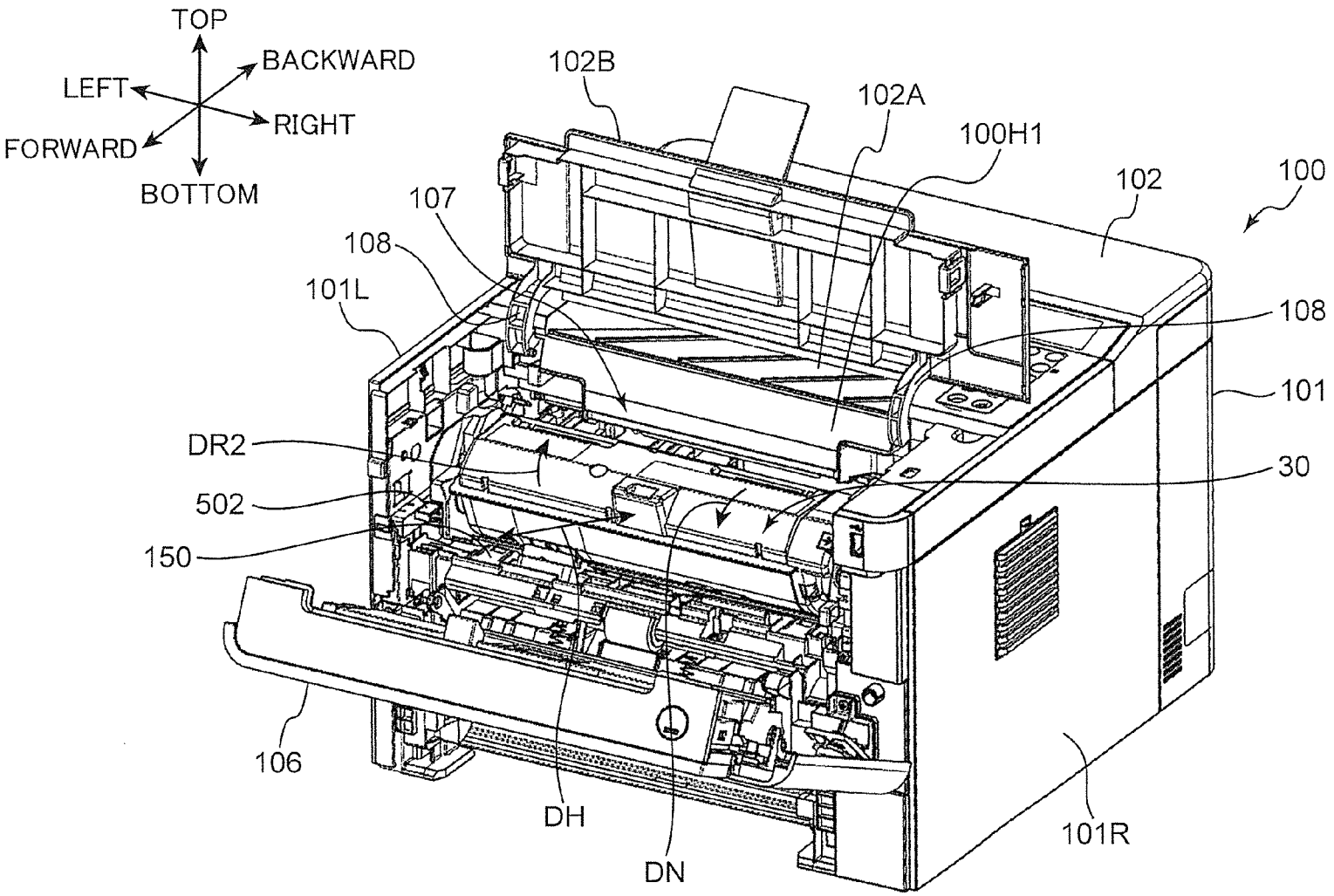
FIG. 1 is a perspective view of an image forming apparatus according to an embodiment of the present disclosure.
Figure 2:
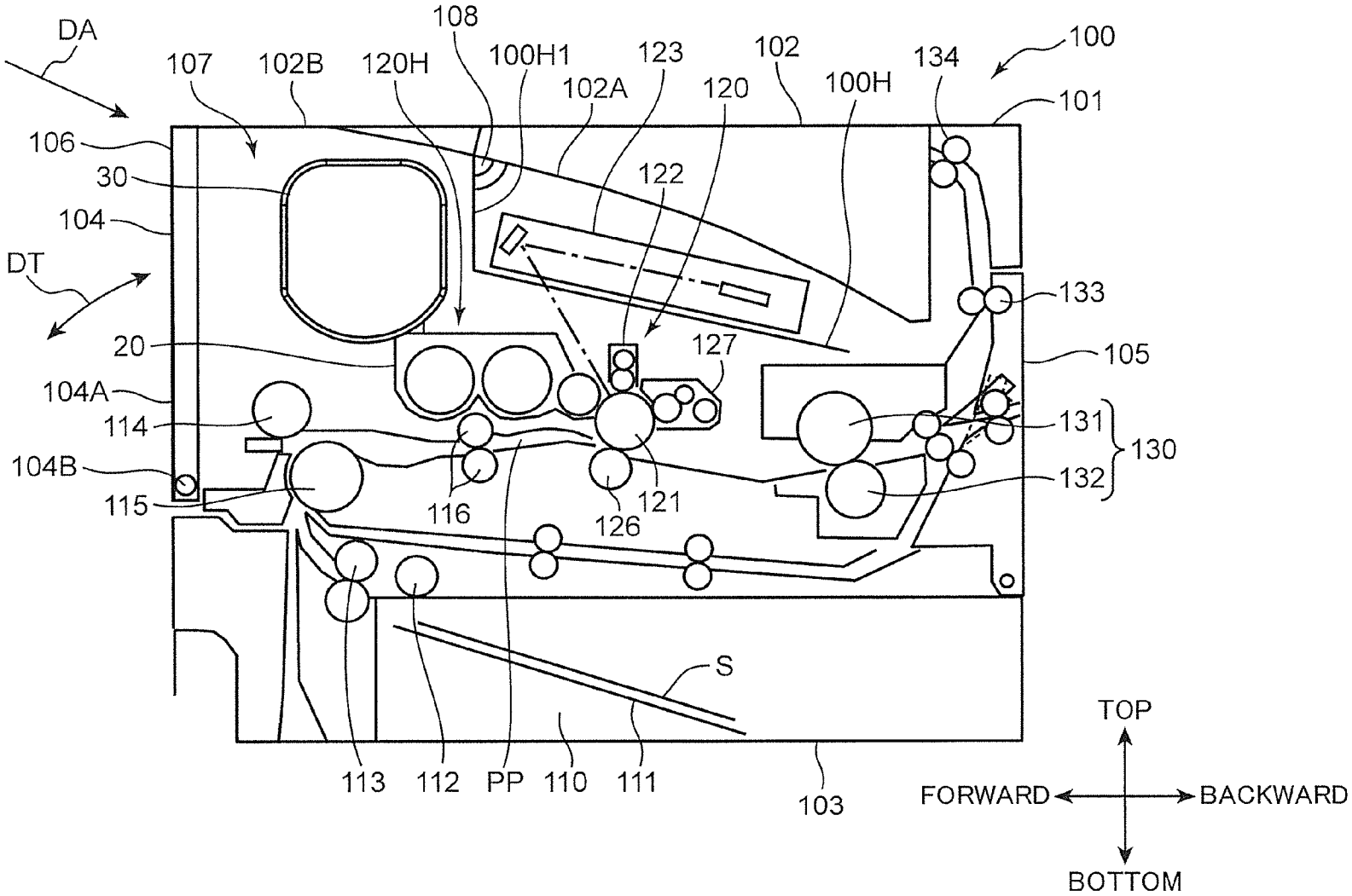
FIG. 2 is an internal sectional view of the image forming apparatus according to the embodiment of the present disclosure.

Hereinafter, an embodiment of the present disclosure will be described with reference to the accompanying drawings. FIG. 1 is a perspective view of a printer 100 (image forming apparatus) according to the present embodiment. FIG. 2 is a schematic sectional view showing an internal structure of the printer 100. The printer 100 shown in FIGS. 1 and 2 is configured as a so-called monochrome printer. However, in other embodiments, other apparatuses may alternatively be provided as the image forming apparatus, such as a color printer, a facsimile apparatus or a multifunctional apparatus equipped with these functions, or another type of apparatus for forming a toner image on a sheet. It should be noted that hereinafter, terms indicating directions such as "top" "bottom" "forward" "backward" "left" and "right" are intended merely for descriptive purposes, and not for limiting the principle of the image forming apparatus.

The printer 100 includes a casing 101 (apparatus body) for housing various components that are used for forming an image on a sheet S. The casing 101 includes a top wall 102 defining the top surface of the casing 101, a bottom wall 103 defining the bottom surface of the casing 101, a main body rear wall 105 connecting the top wall 102 and the bottom wall 103, and a main body front wall 104 lying in front of the main body rear wall 105. The casing 101 includes a main body internal space 107 (internal space) where various components are placed. A sheet conveyance passage PP extends in the main body internal space 107 of the casing 101 for allowing passage of a sheet S therethrough in a predetermined conveying direction. Further, the casing 101 includes a pair of a left wall 101L and a right wall 101R (FIG. 1). The left wall 101L and the right wall 101R define left and right side surfaces of the casing 101.

A sheet discharge section 102A is disposed in a central portion of the top wall 102. The sheet discharge section 102A is defined by an oblique surface sloping downward from a front end to a rear end of the top wall 102. A sheet S having been subjected to image formation in an image forming section 120 described later is discharged onto the sheet discharge section 102A. Further, a front cover 106 (cover member) and a manual feed tray 104A are disposed in the main body front wall 104. The front cover 106 and the manual feed tray 104A are vertically openable with respective lower ends acting as a fulcrum (as indicated by the arrow DT shown in FIG. 2). The manual feed tray 104A is pivotable with respect to the front cover 106. The manual feed tray 104A includes a tray support portion 104B serving as the above-mentioned fulcrum. It should be noted that FIG. 1 shows a state that the front cover 106 including the manual feed tray 104A is opened from the casing 101. The front cover 106 and the manual feed tray 104A constitute a portion of the main body front wall 104 in the state of closing the casing 101.

A front end portion 102B of the top wall 102 is pivotable backward with an arm 108 acting as a fulcrum (FIG. 1). As shown in FIG. 1, when both of the front end portion 102B of the top wall 102 and the front cover 106 are opened, the main body internal space 107 is exposed to the outside of the printer 100. This allows mounting of a developing unit 120H and a toner container 30 described later into the casing 101. Further, this allows removal of a sheet S when the sheet S is jammed in the sheet conveyance passage PP.

With reference to FIG. 2, the printer 100 includes a cassette 110, a pickup roller 112, a first sheet feeding roller 113, a second sheet feeding roller 114, a conveying roller 115, a pair of registration rollers 116, the image forming section 120, and a fixing device 130.

The cassette 110 stores sheets S. The cassette 110 includes a lift plate 111. The lift plate 111 is tilted to lift the leading edges of the sheets S. The cassette 110 can be pulled out forwardly with respect to the casing 101.

The pickup roller 112 is disposed above the leading edges of sheets S lifted by the lift plate 111. The pickup roller 112 rotates to draw a sheet S from the cassette 110.

The first sheet feeding roller 113 is disposed downstream of the pickup roller 112 and conveys a sheet S further downstream. The second sheet feeding roller 114 is disposed at the inner side (rear side) of the fulcrum of the manual feed tray 104A and draws a sheet S placed on the manual feed tray 104A into the casing 101.

The conveying roller 115 is disposed downstream of the first sheet feeding roller 113 and the second sheet feeding roller 114 in the sheet conveying direction (hereinafter, the sheet conveying direction also being simply referred to as "conveying direction", and the downstream in the sheet conveying direction also being simply referred to as "downstream"). The conveying roller 115 conveys a sheet S fed by the first sheet feeding roller 113 or the second sheet feeding roller 114 further downstream.

The pair of registration rollers 116 functions to correct the angle of a sheet S that has been obliquely conveyed. Thus, it is possible to adjust the position of an image to be formed on the sheet S. The pair of registration rollers 116 supplies the sheet S to the image forming section 120 in accordance with the timing of image formation to be performed by the image forming section 120.

The image forming section 120 includes a photoconductive drum 121 (image carrier), a charger 122, an exposure device 123, a developing device 20, the toner container 30 (developer container), a transferring roller 126, and a cleaning device 127. The developing device 20 and the toner container 30 can be integrally mounted in and dismounted from the casing 101 as the developing unit 120H.

The photoconductive drum 121 is in the form of a cylinder, and rotatably supported on the casing 101. The photoconductive drum 121 has a circumferential surface which allows an electrostatic latent image to be formed thereon, and carries a toner image (developed image) corresponding to the electrostatic latent image thereon. The charger 122 is applied with a predetermined voltage, and charges the circumferential surface of the photoconductive drum 121 substantially uniformly.

The exposure device 123 irradiates the circumferential surface of the photoconductive drum 121 charged by the charger 122 with beams of laser light. The beams of laser light are emitted in accordance with image data output from an external device (not shown) such as a personal computer which is communicably connected to the printer 100. Consequently, the circumferential surface of the photoconductive drum 121 is formed with an electrostatic latent image corresponding to the image data. The exposure device 123 is supported by a support frame 100H (FIG. 2). The support frame 100H is disposed in the casing 101. The support frame 100H is disposed in such a manner as to extend along the sheet discharge section 102A sloping downward and backward. The support frame 100H includes a frame front wall 100H1 standing at a front end of the support frame 100H. The frame front wall 100H1 is disposed directly under the sheet discharge section 102A, and extends in a vertical direction. The frame front wall 100H1 faces the toner container 30 (FIG. 2).

The developing device 20 supplies toner to the circumferential surface of the photoconductive drum 121 having an electrostatic latent image formed thereon. The toner container 30 contains toner and supplies the toner to the developing device 20. The toner container 30 is detachably mounted on the developing device 20. The developing device 20 supplies toner to the photoconductive drum 121 to develop (visualize) the electrostatic latent image formed on the circumferential surface of the photoconductive drum 121. Consequently, the circumferential surface of the photoconductive drum 121 is formed with a toner image (developed image).

The transferring roller 126 is disposed under the photoconductive drum 121 and faces the photoconductive drum 121 across the sheet conveying passage PP. The transferring roller 126 defines a transfer nip in cooperation with the photoconductive drum 121, and transfers a toner image onto a sheet S.

The cleaning device 127 removes, after a toner image is transferred onto a sheet S from the circumferential surface of the photoconductive drum 121, toner remaining on the circumferential surface.

The fixing device 130 is disposed downstream of the image forming section 120 in the conveying direction, and fixes a toner image on a sheet S. The fixing device 130 includes a heating roller 131 for melting toner on the sheet S, and a pressure roller 132 for bringing the sheet S into close contact with the heating roller 131.

The printer 100 further includes a pair of conveying rollers 133 disposed downstream of the fixing device 130, and a pair of discharge rollers 134 disposed downstream of the pair of conveying rollers 133. A sheet S is conveyed upward by the pair of conveying rollers 133 to be finally discharged from the casing 101 by the pair of discharge rollers 134. The sheet S discharged from the casing 101 is placed on the sheet discharge section 102A, thereby resulting in a stack of sheets.

<Structure of Developing Unit>

Figure 3:
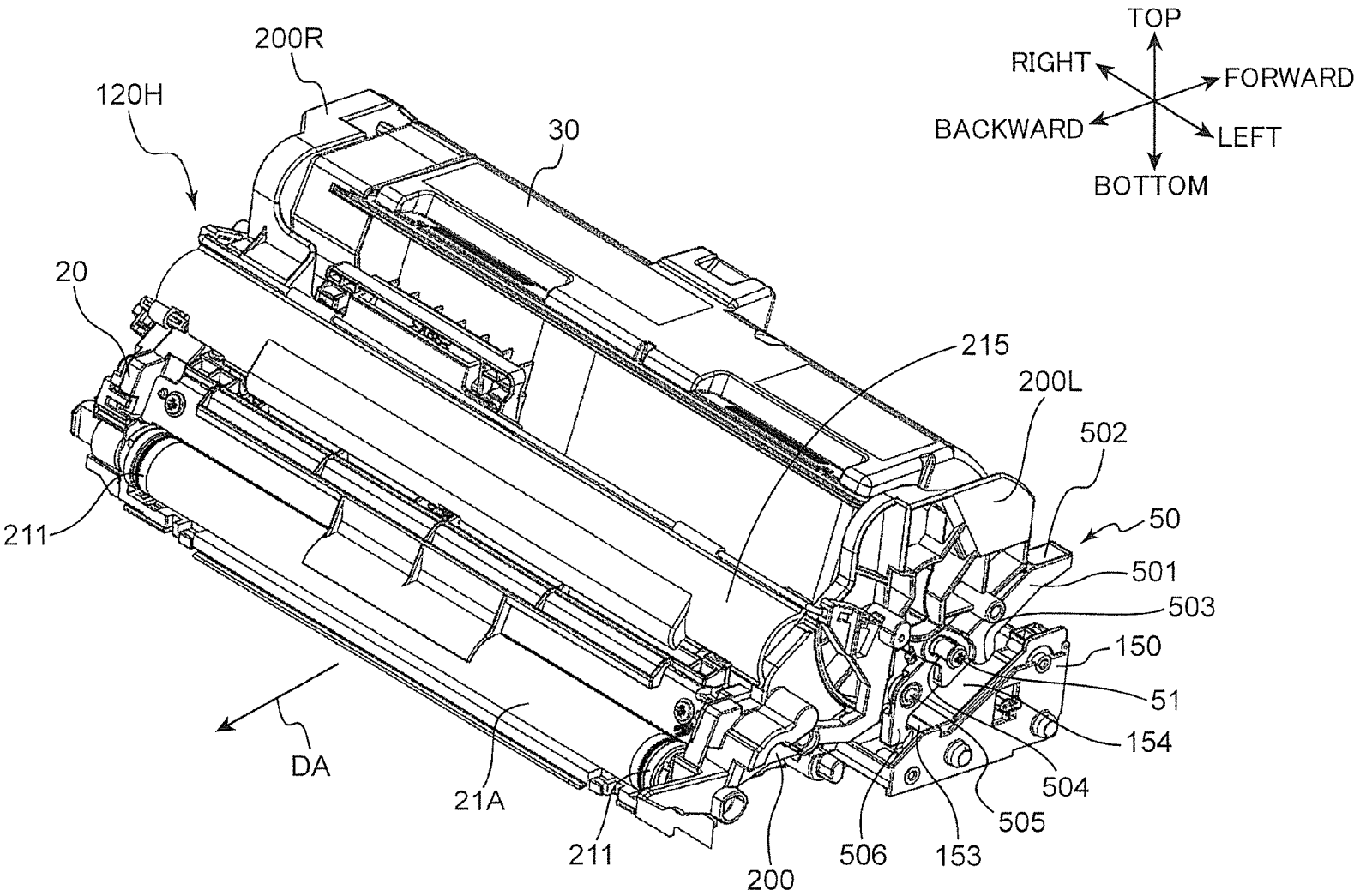
FIG. 3 is a perspective view of a developing unit and a guide section according to the embodiment of the present disclosure.
Figure 4:
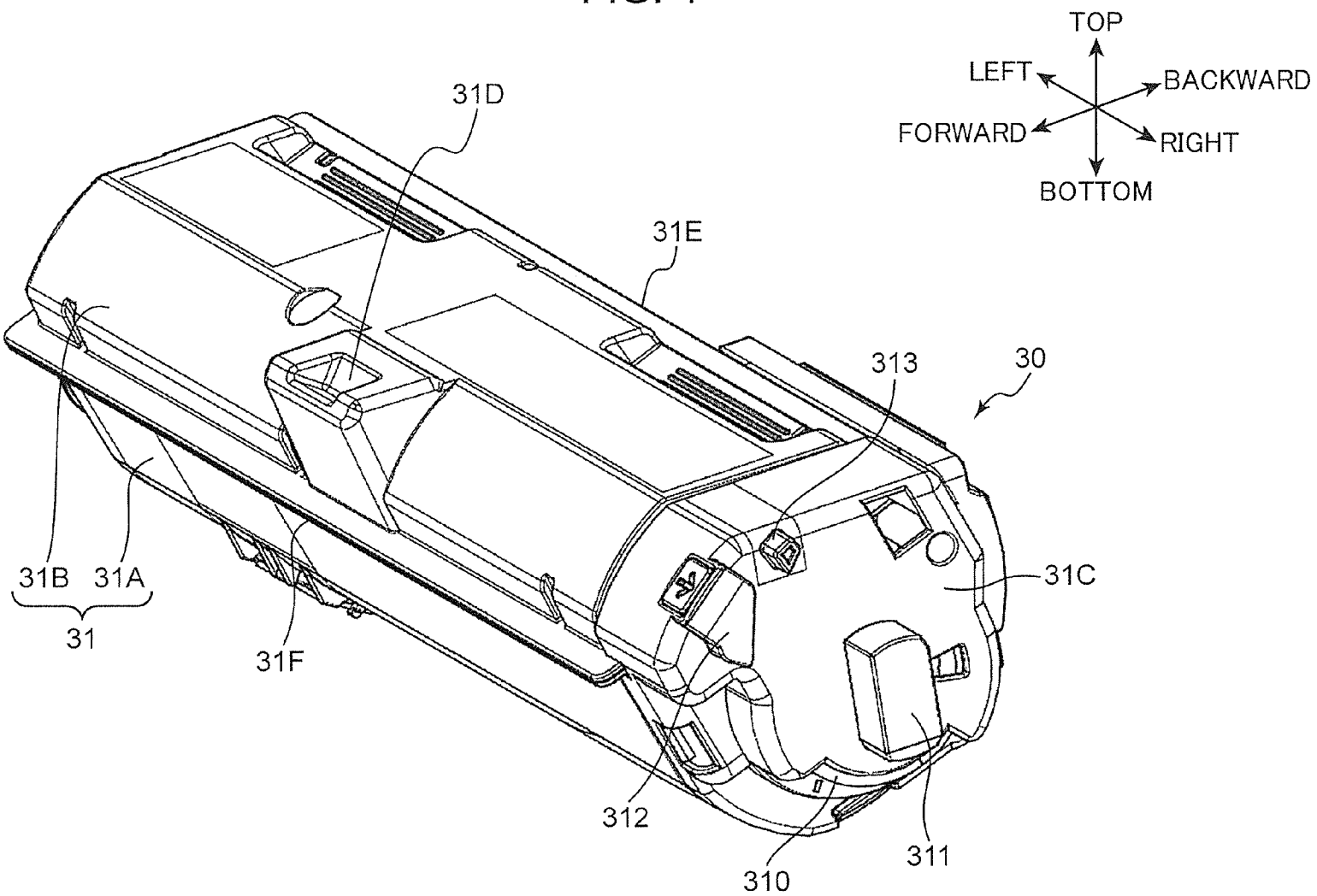
FIG. 4 is a perspective view of a developer container according to the embodiment of the present disclosure.
Figure 5:
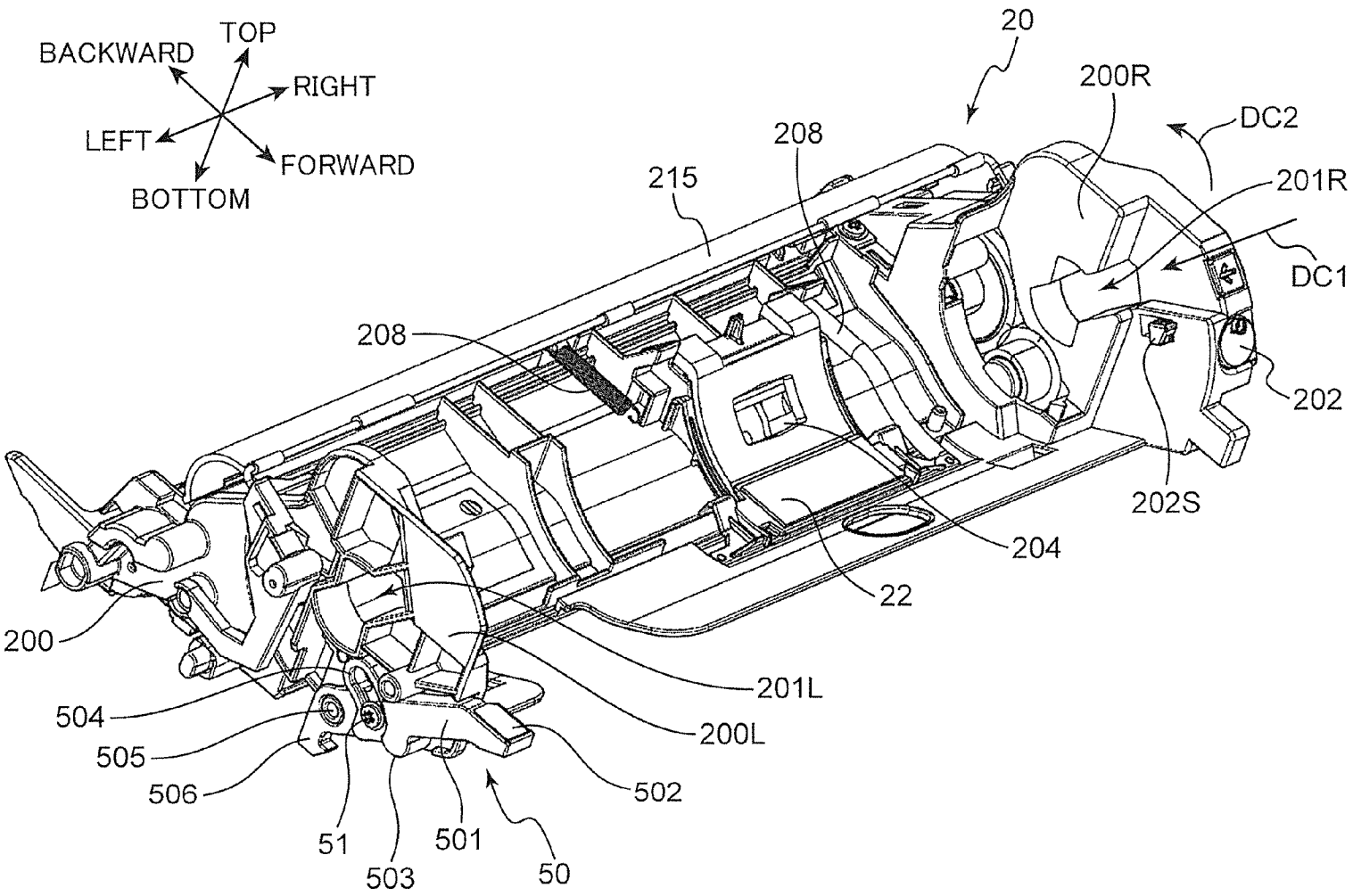
FIG. 5 is a perspective view of a developing device according to the embodiment of the present disclosure.
Figure 6:
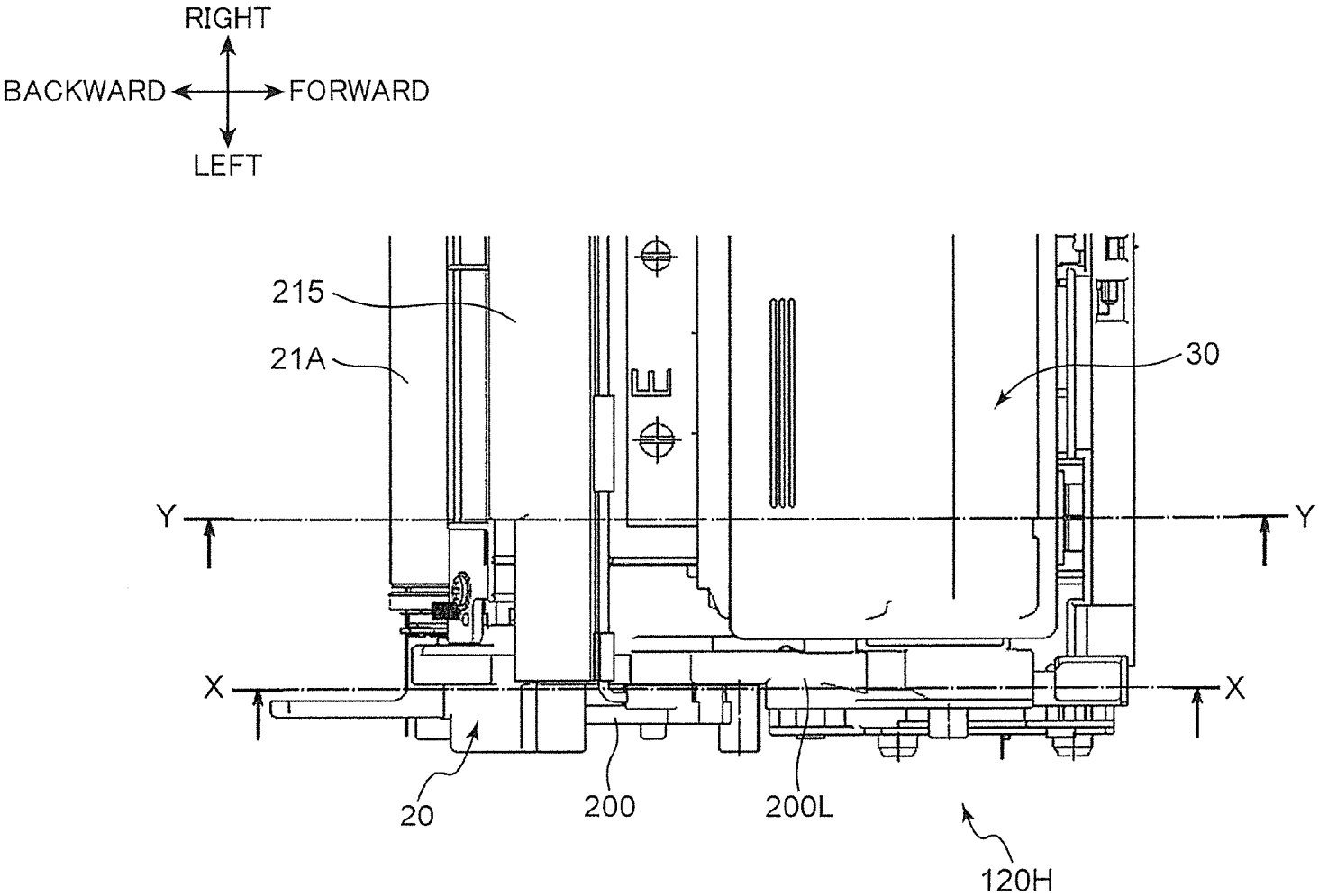
FIG. 6 is a top view of a portion of the developing unit according to the embodiment of the present disclosure.

Now, the developing unit 120H (the developing device 20H and the toner container 30) according to the present embodiment will be described in detail with reference to FIGS. 3 to 10. FIG. 3 is a perspective view of the developing unit 120H and a main body unit 150 (a portion of the casing 101) according to the present embodiment. FIG. 4 is a perspective view of the toner container 30 according to the present embodiment. FIG. 5 is a perspective view of the developing device 20 according to the present embodiment. FIG. 6 is a top view of a portion of the developing unit 120H. FIGS. 7 to 10 are sectional views of the developing unit 120H and the main body unit 150, FIGS. 7 and 8 being sectional views taken along the line X-X in FIG. 6, and FIGS. 9 and 10 being sectional views taken along the line Y-Y in FIG. 6.

As described above, the developing unit 120H (FIG. 3) includes the developing device 20 and the toner container 30. The developing unit 120H can be mounted in and dismounted from the casing 101 in a specific mounting/dismounting direction. Thus, the toner container 30 can be mounted in the casing 101 integrally with the developing device 20. In the case that the developing device 20 is mounted in the casing 101 in advance, the toner container 30 is individually mounted on the developing device 20 disposed in the casing 101. The arrows DA shown in FIGS. 2 and 3 indicate the mounting direction in which the developing unit 120H is mounted into the casing 101.

Figure 7:
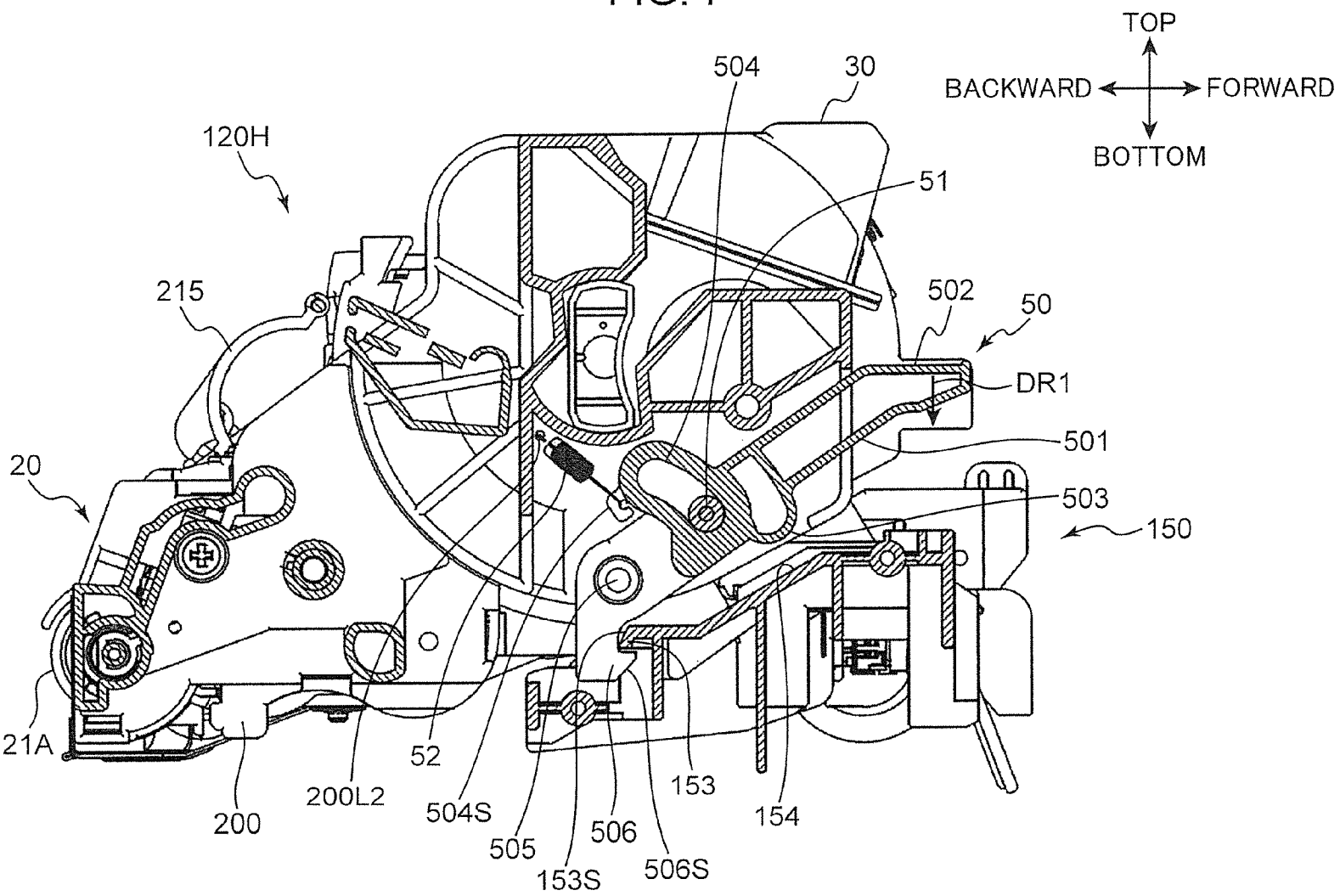
FIG. 7 is a sectional view of the developing unit and the guide section according to the embodiment of the present disclosure.

Further, the printer 100 includes the main body unit 150 (FIGS. 3 and 7). The main body unit 150 is disposed in the casing 101, and guides the mounting and the dismounting of the developing unit 120H. As shown in FIG. 1, when the front cover 106 is opened from the casing 101, the main body unit 150 is exposed to the outside of the casing 101. The developing unit 120H passes over the main body unit 150 to be mounted in the main body internal space 107 of the casing 101. As shown in FIG. 3, the main body unit 150 has a generally triangular shape in side view, and has a longer dimension in a left/right direction. The main body unit 150 includes a pair of positioning mechanisms 150S (FIG. 9), an engaged portion 153 (FIGS. 3 and 7), and a guide surface 154.

The pair of positioning mechanisms 150S are disposed at the opposite ends of the main body unit 150 in the left/right direction. The positioning mechanism 150S includes a unit contact portion 151 (contact portion) and a unit biasing spring 152 (biasing spring). The unit contact portion 151 is in contact with a housing pushed portion 200K (FIG. 9) of the developing unit 120H mounted in the casing 101. The unit biasing spring 152 biases the unit contact portion 151 backward. In other words, the positioning mechanism 150S including the unit biasing spring 152 biases the developing unit 120H mounted on a developing position in the casing 101 backward, thereby positioning the developing unit 120H.

The guide surface 154 (FIG. 7) is defined on a top surface of the main body unit 150. The guide surface 154 has a function to guide the mounting of the developing unit 120H. The guide surface 154 has an oblique surface slowing downward from front to rear. A rear end of the guide surface 154 that lies at the rear side of the oblique surface is in the form of a flat surface. The engaged portion 153 is disposed downstream of the guide surface 154 in the mounting direction (in the direction of the arrow DA shown in FIG. 3) of the developing unit 120H. The engaged portion 153 is engageable with a hook 506 (FIG. 7) of a lock lever 50 described later.

With reference to FIG. 4, the toner container 30 contains toner (developer). The toner container 30 includes a container body 31 (container body), and a container cover 31C. The container body 31 has a longer dimension in the left/right direction (longitudinal direction). The container body 31 includes a body portion 31A and a lid portion 31B. The body portion 31A defines a lower portion of the container body 31. The body portion 31A is open at the top.

The lid portion 31B is secured to the body portion 31A in such a manner as to close the opening of the body portion 31A. In the present embodiment, the lid portion 31B is secured to the body portion 31A by welding. At this time, the body portion 31A and the lid portion 31B are secured at a container flange 31F formed along the rim of the opening of the body portion 31A. The lid portion 31B includes a first holder part 31D and a second holder part 31E. In the mounting of the toner container 30 onto the developing device 20 or mounting of the developing unit 120H including the toner container 30 and the developing device 20 into the casing 101, the user can hold the first holder part 31D and the second holder part 31F.

The container cover 31C is attached to the right side of the container body 31. The container cover 31C includes a right guide 311, a transmission gear 310, a first lock engaging portion 312, and a second lock engaging portion 313. The right guide 311 projects from the container cover 31C and has a substantially rectangular parallelepiped shape. It should be noted that, though not shown in FIG. 4, a left guide 301 having the same shape as the right guide 311 is also disposed on the left side of the toner container 30 (see FIG. 11). These guides guide the mounting of the toner container 30 onto the developing device 20. The transmission gear 310 transmits a torque to a container paddle 30K described later. The first lock engaging portion 312 and the second lock engaging portion 313 are each in the form of a projection extending from the container cover 31C. The first lock engaging portion 312 and the second lock engaging portion 313 will be described in detail later.

Figure 9:
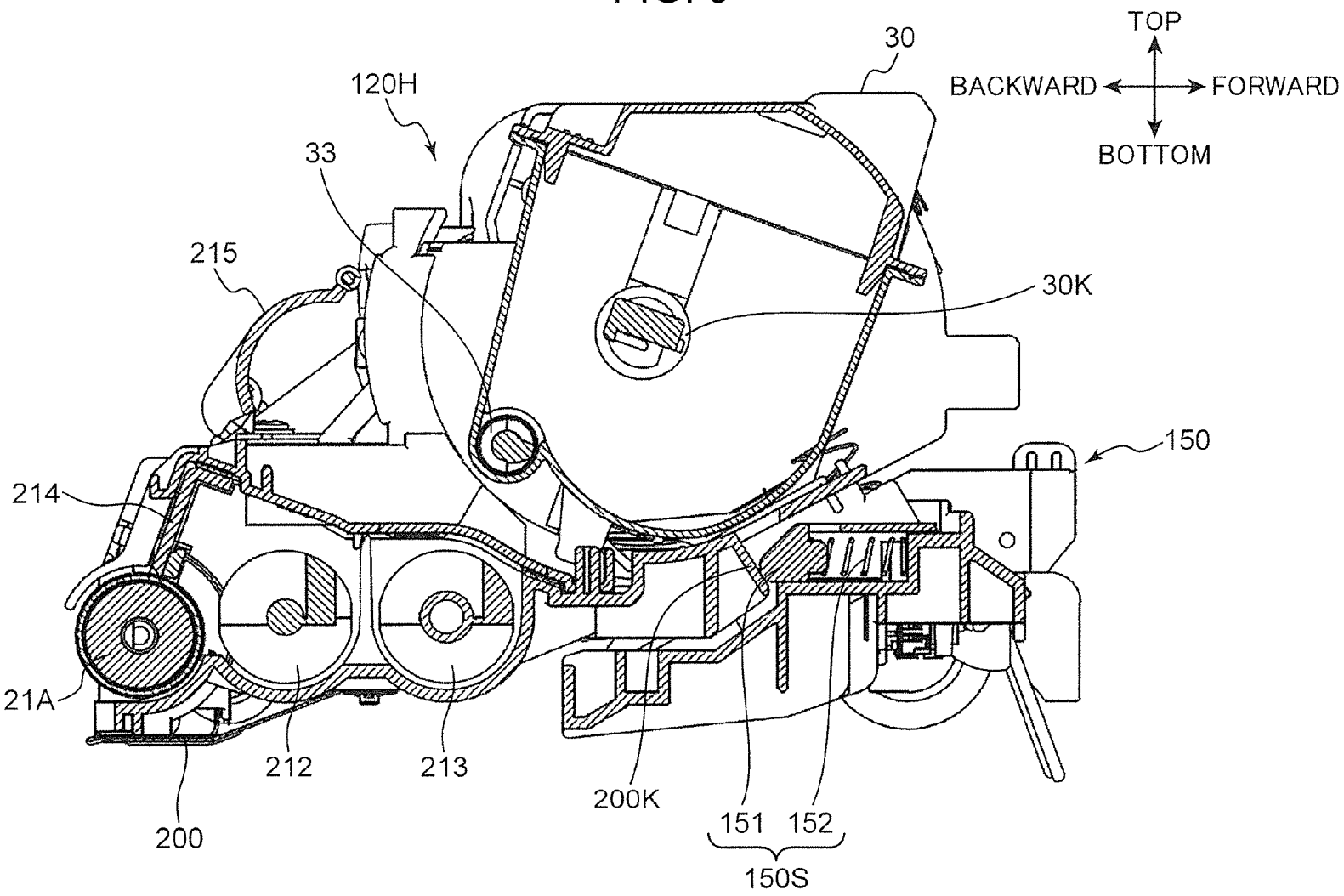
FIG. 9 is a sectional view of the developing unit and the guide section according to the embodiment of the present disclosure.

Further, the toner container 30 includes a container screw 33 and the container paddle 30K (stirring member) (FIG. 9).

The container screw 33 is disposed along the bottom of the body portion 31A. A toner discharge port 30P (FIG. 12) described later is formed in the bottom of the body portion 31A. The container screw 33 is rotated to convey toner in the container body 31 to the toner discharge port 30P. A container shutter 32 (FIG. 11) described later is provided in the container body 31 and is slid to open the toner discharge port 30P to allow discharge of toner from the toner container 30. The container paddle 30K is rotatably supported in the toner container 30 and stirs toner contained in the toner container 30. In the present embodiment, a rotary axis of the container paddle 30K extends in the left/right direction and in parallel with a rotary axis of the photoconductive drum 121.

The developing device 20 includes a development housing 200 (FIG. 3), a developing roller 21A (FIGS. 3 and 9), a pair of contact rollers 211 (FIG. 3), a first screw 212 (FIG. 9), a second screw 213 (FIG. 9), a layer thickness regulating member 214 (FIG. 9), and a developing roller cover 215.

The development housing 200 supports the components of the developing device 20. The development housing 200 has a function to support the toner container 30. With reference to FIG. 5, the development housing 200 includes a housing left wall 200L, a housing right wall 200R, and a toner supply port 204 (developer supply port). The housing left wall 200L and the housing right wall 200R vertically disposed at the opposite ends of the development housing 200 in the left/right direction. The toner container 30 is mounted in between the housing left wall 200L and the housing right wall 200R.

The housing right wall 200R includes a right guide groove 201R, a locking contact piece 202S, and a lock button 202. The housing left wall 200L includes a left guide groove 201L. The right guide groove 201R and the left guide groove 201L are guide grooves formed in the housing right wall 200R and the housing left wall 200L, respectively. These guide grooves are formed in the mounting direction (in the direction of the arrow DC1 shown in FIG. 5) in which the toner container 30 is mounted into the development housing 200. The right guide 311 (FIG. 4) of the toner container 30 is brought into the right guide groove 201R. Further, the left guide 301 (FIG. 11) disposed on the left side of the toner container 30 is brought into the left guide groove 201L. The toner container 30 is inserted into a space above the development housing 200 and then rotated in the direction of the arrow DC2 shown in FIG. 5. Consequently, the toner discharge port 30P of the toner container 30 faces the toner supply port 204 to allow supply of toner (developer) from the toner container 30 to the developing device 20. Respective furthest end portions of the left guide groove 201L and the right guide groove 201R are in the form of a sector to permit rotation of the left guide 301 and the right guide 311 (FIG. 5). The structure for mounting the toner container 30 to the development housing 200 of the developing device 20 will be described in detail later.

The locking contact piece 202S locks the toner container 30 having rotated in the arrow DC2 direction. When the lock button 202 is pushed, the locking of the toner container 30 is released to rotate the toner container 30 in the direction opposite to the arrow DC2 direction shown in FIG. 5. Consequently, the toner container 30 becomes dismountable from the developing device 20 in the direction opposite to the arrow DC1 direction.

The developing roller 21A is rotatably supported on the development housing 200. A rotary axis of the developing roller 21A extends in parallel with the rotary axis of the photoconductive drum 121. The developing roller 21A carries developer containing toner on its circumferential surface. The developing roller 21A supplies the toner to the photoconductive drum 121 to develop an electrostatic latent image formed on the photoconductive drum 121. The pair of contact rollers 211 are disposed on the axially opposite ends of the developing roller 21A. The contact rollers 211 come into contact with the circumferential surface of the photoconductive drum 121 to thereby keep the distance between the developing roller 21A and the photoconductive drum 121 constant. The first screw 212 and the second screw 213 are rotatably supported in the development housing 200. Developer in the development housing 200 is circularly conveyed by the first screw 212 and the second screw 213. Further, the developer is supplied to the developing roller 21A by the first screw 212. The layer thickness regulating member 214 regulates the layer thickness of developer supplied on the developing roller 21A. The developing roller cover 215 is pivotable with respect to the development housing 200. FIG. 3 illustrates a state where the developing roller cove 215 has receded to a position above the developing roller 21A. The developing roller cover 215 can cover the developing roller 21A by being pivoted downward from the state shown in FIG. 3. Therefore, it is possible to prevent adhesion of foreign matter on the developing roller 21A or toner stains around the developing roller 21A due to the toner on the developing roller 21A after the dismounting of the developing unit 120H from the casing 101.

Further, the developing device 20 includes the lock lever 50 (FIGS. 3 and 5). The lock lever 50 is pivotally disposed on the housing left wall 200L of the developing device 20. The lock lever 50 can change from a locking posture of locking the developing unit 120H (developing device 20) at the developing position described later to a releasing posture of releasing the locking of the developing unit 120H to permit the developing unit 120H to be dismounted from the casing 101 in the dismounting direction opposite to the mounting direction, and vice versa, in the casing 101.

With reference to FIGS. 3, 5 and 7, the lock lever 50 includes a lever body 501, a lever pushed portion 502, a lever contact portion 503, a guide groove 504, a support portion 505, and the hook 506.

The lever body 501 constitutes the body of the lock lever 50, and extends obliquely from upper front to lower rear, as shown in FIG. 7. The lever pushed portion 502 is in the form of a flat portion disposed on an upper end of the lever body 501. The lever pushed portion 502 is pushed by the user before the dismounting of the developing unit 120H from the casing 101. The lever contact portion 503 is disposed in a substantially central portion of the lock lever 50 in a forward/backward direction, and projects downward in an arc shape. When the developing unit 120H is mounted in the casing 101, the lever contact portion 503 faces the guide surface 154 of the main body unit 150, as shown in FIGS. 3 and 7. The guide groove 504 is formed at the rear side of the lever contact portion 503. The guide groove 504 defines an arc centered on the support portion 505. At the rear side of the guide groove 504, a lever-side fastening portion 504S is disposed. The lever-side fastening portion 504S is in the form of a hook projecting from the lock lever 50. One end of a lever biasing spring 52 described later is fastened to the lever-side fastening portion 504S.

The support portion 505 is disposed in a rear end of the lock lever 50. The support portion 505 is rotatably supported on the housing left wall 200L of the development housing 200. The support portion 505 acts as a fulcrum for pivotal movement of the lock lever 50. The lever contact portion 503 is disposed between the support portion 505 and the lever pushed portion 502 (FIG. 7). The hook 506 is disposed on the opposite side of the lever pushed portion 502 with respect to the support portion 505. The hook 506 is engageable with the engaged portion 153 (FIG. 7) of the main body unit 150. As shown in FIG. 7, the hook 506 extends downward from the support portion 505 and has a distal end extending forward (upstream in the mounting direction of the developing unit 120H).

Further, the developing device 20 includes a guide screw 51 and the lever biasing spring 52 (FIG. 7). The guide screw 51 is inserted in the guide groove 504 and is fastened to the housing left wall 200L. The guide screw 51 functions to guide the pivotal movement of the lock lever 50 along the guide groove 504.

The lever biasing spring 52 expands and contracts between the housing left wall 200L of the development housing 200 and the lock lever 50. The housing left wall 200L includes a housing-side fastening portion 200L2. As shown in FIG. 7, one end of the lever biasing spring 52 is fastened to the lever-side fastening portion 504S of the lock lever 50, and the other end of the lever biasing spring 52 is fastened to the housing-side fastening portion 200L2. Consequently, the lever biasing spring 52 biases the lock lever 50 around the support portion 505 so that the hook 506 engages with the engaged portion 153 (FIG. 7).

<Mounting and Dismounting of Developing Unit>

Now, the mounting and the dismounting of the developing unit 120H into and from the casing 101 will be described. As mentioned above, the developing unit 120H is constituted by the developing device 20 and the toner container 30. The toner container 30 can be mounted onto and dismounted from the developing device 20. The developing unit 120H including only the developing device 20 without the toner container 30 can also be mounted in the casing 101. Here, the description illustrates the mounting and the dismounting of the developing unit 120H including the toner container 30, but the independent mounting and dismounting of the developing device 20 into and from the casing 101 is performed in the same manner.

As shown in FIG. 1, the front cover 106 and the front end portion 102B of the top wall 102 of the casing 101 are opened to allow mounting of the developing unit 120H into the main body internal space 107 of the casing 101. At this time, the developing unit 120H is inserted into the main body internal space 107 in the arrow DA direction shown in FIGS. 2 and 3. The main body unit 150 (FIG. 3) guides a lower portion of the developing unit 120H. In the course of mounting of the developing unit 120H, the hook 506 of the lock lever 50 goes into the interior while sliding on the guide surface 154 until an oblique surface 506S (FIG. 7) of the hook 506 comes into sliding contact with an oblique surface 153S of the engaged portion 153. At this time, the hook 506 slightly pivots clockwise about the support portion 505, so that the distal end of the hook 506 goes into a position under the engaged portion 153, as shown in FIG. 7. Consequently, the hook 506 engages with the engaged portion 153 to lock the developing unit 120H at the developing position shown in FIG. 7. The posture of the lock lever 50 shown in FIG. 7 is defined as the locking posture of the lock lever 50. At this time, as shown in FIG. 9, the housing pushed portion 200K of the development housing 200 is pushed backward by the unit contact portion 151 of the positioning mechanism 150S. In other words, the positioning mechanism 150S biases the developing unit 120H in a direction to bring the developing roller 21A closer to the photoconductive drum 121. When the developing unit 120H is positioned at the developing position shown in FIGS. 7 and 9 in the casing 101, the contact rollers 211 (FIG. 3) are in contact with the circumferential surface of the photoconductive drum 121 so that the developing roller 21A lies at a predetermined distance from the photoconductive drum 121. Consequently, toner is stably supplied from the developing roller 21A to the photoconductive drum 121 to form a toner image on the photoconductive drum 121.

Figure 8:
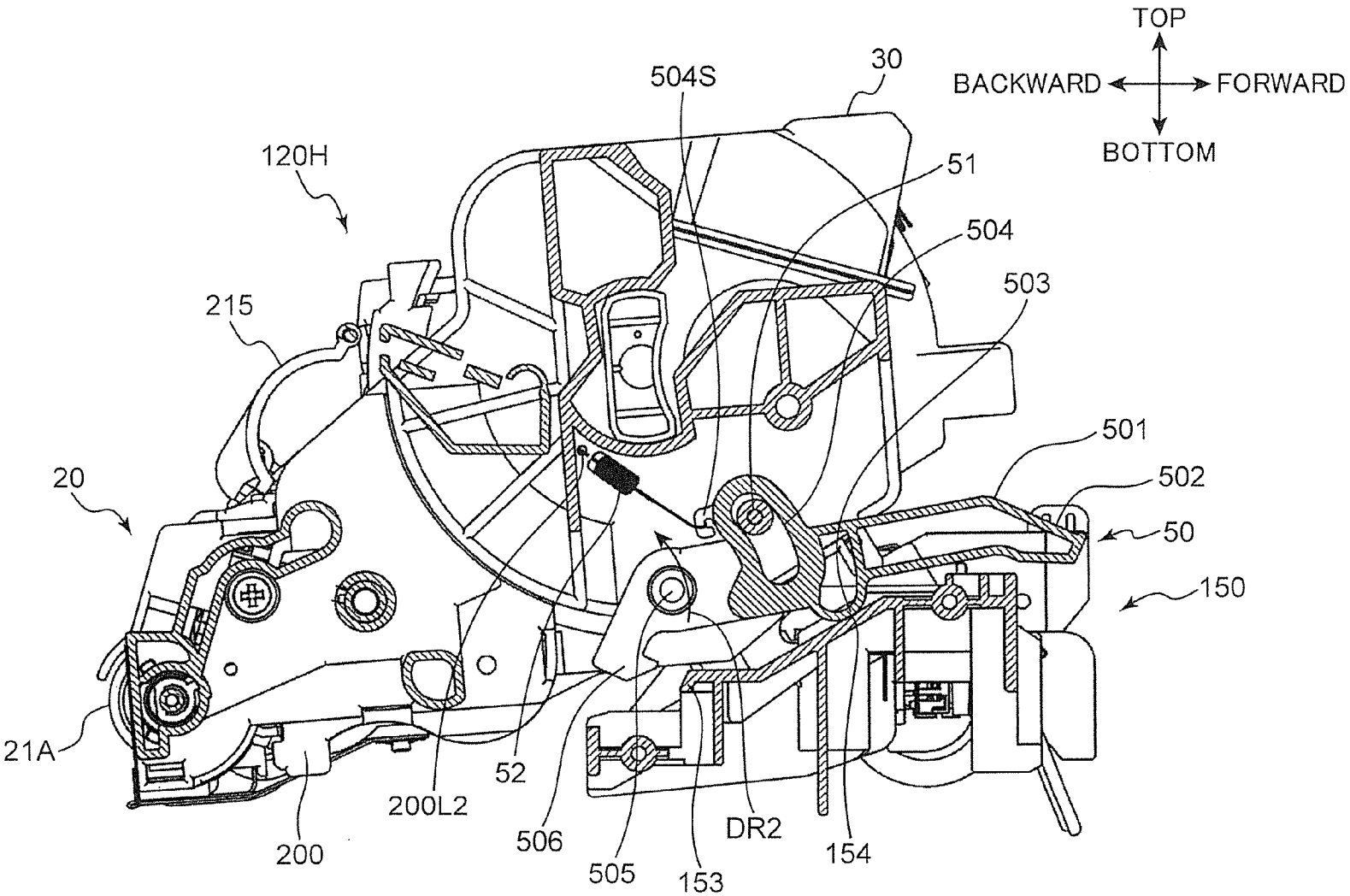
FIG. 8 is a sectional view of the developing unit and the guide section according to the embodiment of the present disclosure.
Figure 10:
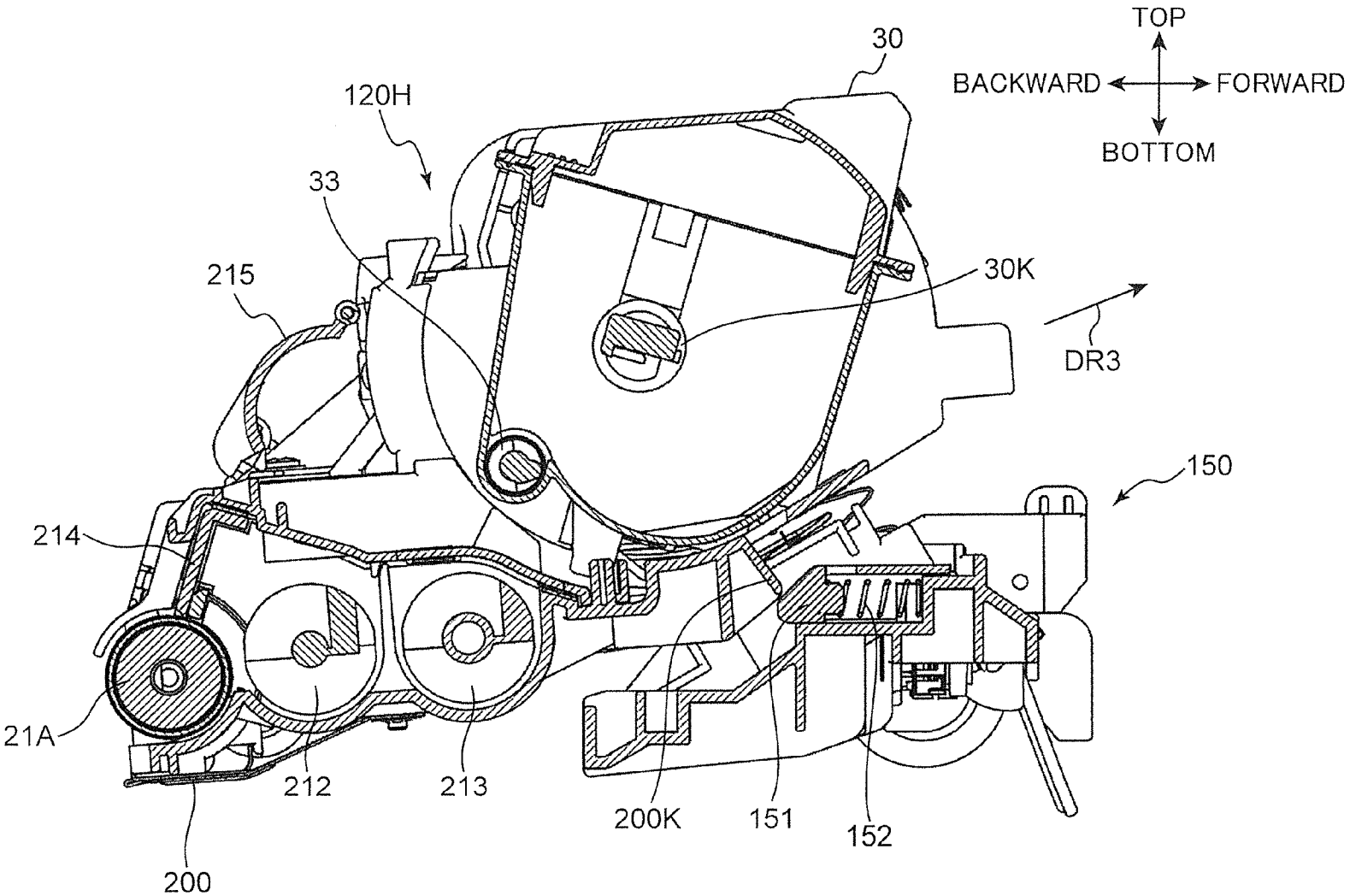
FIG. 10 is a sectional view of the developing unit and the guide section according to the embodiment of the present disclosure.

In the dismounting of the developing unit 120H from the casing 101, the front cover 106 and the front end portion 102B of the top wall 102 of the casing 101 are opened to expose the lever pushed portion 502 of the lock lever 50 to the outside of the printer 100, as shown in FIG. 1. The user first pushes the lever pushed portion 502 downward (in the direction of the arrow DR1 shown in FIG. 7). Consequently, the lock lever 50 pivots about the support portion 505 against the biasing force of the lever biasing spring 52 to change into the releasing posture shown in FIG. 8. At this time, the hook 506 disengages from the engaged portion 153. Thereafter, the lever pushed portion 502 is further pushed to bring the lever contact portion 503 of the lever 50 into contact with the guide surface 154 as shown in FIG. 8. Consequently, the developing unit 120H is raised to a standby position above the developing position shown in FIG. 7 (in the direction of the arrow DR2 shown in FIGS. 1 and 8) by allowing the lever contact portion 503 to serve as the fulcrum, and the support portion 505 to serve as the point of load application. At this time, the developing unit 120H (developing device 20) is rotated to the standby position around the rotary axis of the developing roller 21A. Consequently, the housing pushed portion 200K rides on the oblique surface of the unit contact portion 151, which releases the positioning of the developing unit 120H by the positioning mechanisms 150S, as shown in FIG. 10. At this time, the biasing force of the positioning mechanisms 150S (unit biasing springs 152) is not strongly applied to the development housing 200. Therefore, the developing unit 120H can be easily dismounted from the casing 101 in the dismounting direction (in the direction of the arrow DR3 shown in FIG. 10).

Further, as shown in FIG. 8, after the developing unit 120H is raised in the arrow DR2 direction, the hook 506 comes into contact with the guide surface 154 (the above-mentioned flat surface) lying above the engaged portion 153 owing to the own weight of the developing unit 120H. Consequently, the developing unit 120H is held at the standby position. Thus, the hook 506 is prevented from engaging with the engaged portion 153 again even when the user releases the hand from the lock lever 50. Therefore, the user can dismount the developing unit 120H easily and reliably.

As described, in the present embodiment, the user can move the developing unit 120H from the developing position to the standby position by manipulating the lock lever 50. This allows easy dismounting of the developing unit 120H.

In other embodiments, the oblique surface 506S (FIG. 7) of the hook 506 may be in contact with the oblique surface 153S of the engaged portion 153 in the state that the developing unit 120H is at the standby position after the raising. Also in this case, the lock lever 50 can pivot about the support portion 505 in the course of pulling out of the developing unit 120H (in the arrow DR3 direction shown in FIG. 10), which can prevent the hook 506 from engaging with the engaged portion 153 again, similarly to the above-described case.

<Structures of Toner Container and Developing Device>

Figure 11:
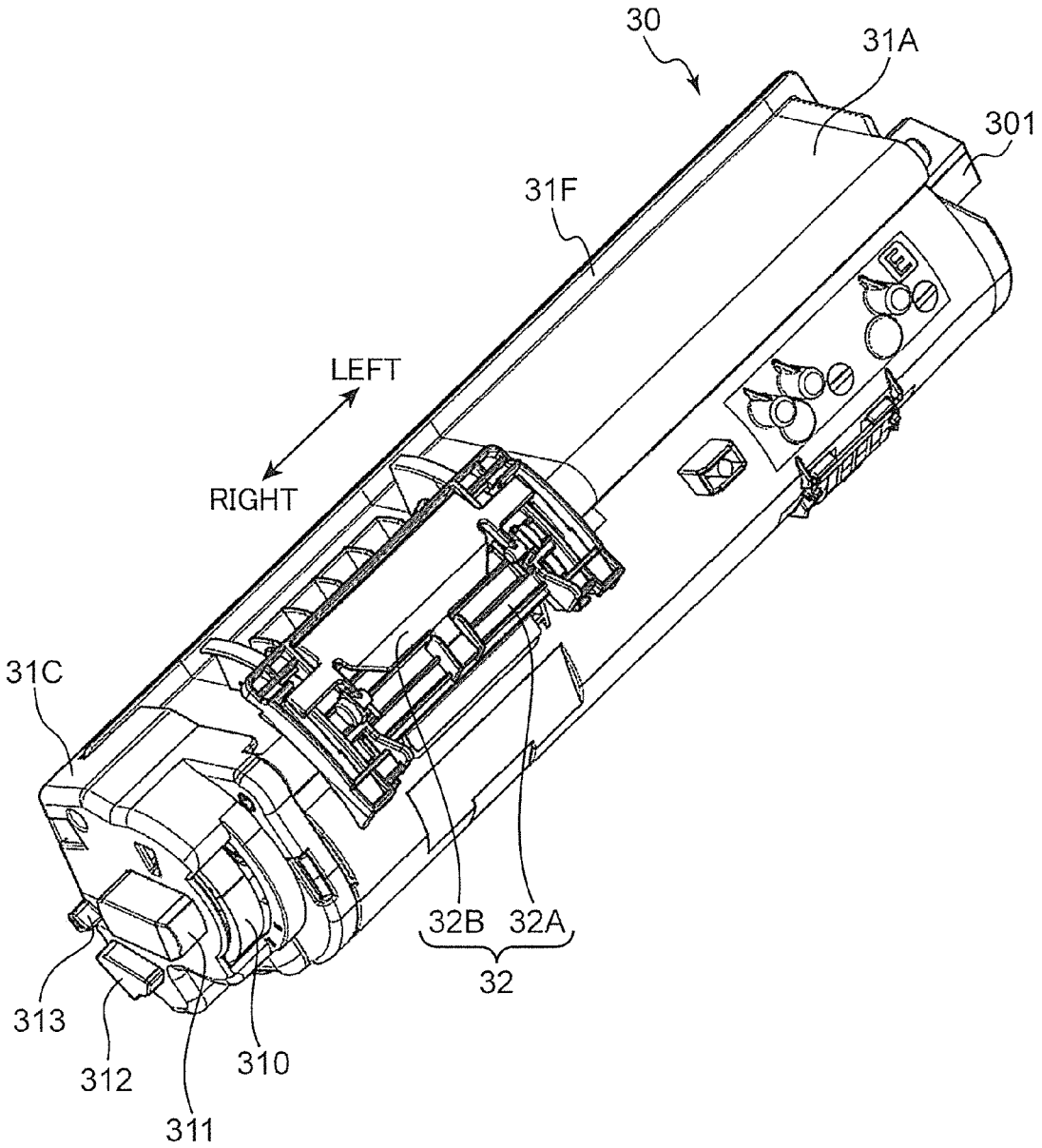
FIG. 11 is a perspective view of the developer container according to the embodiment of the present disclosure.
Figure 12:
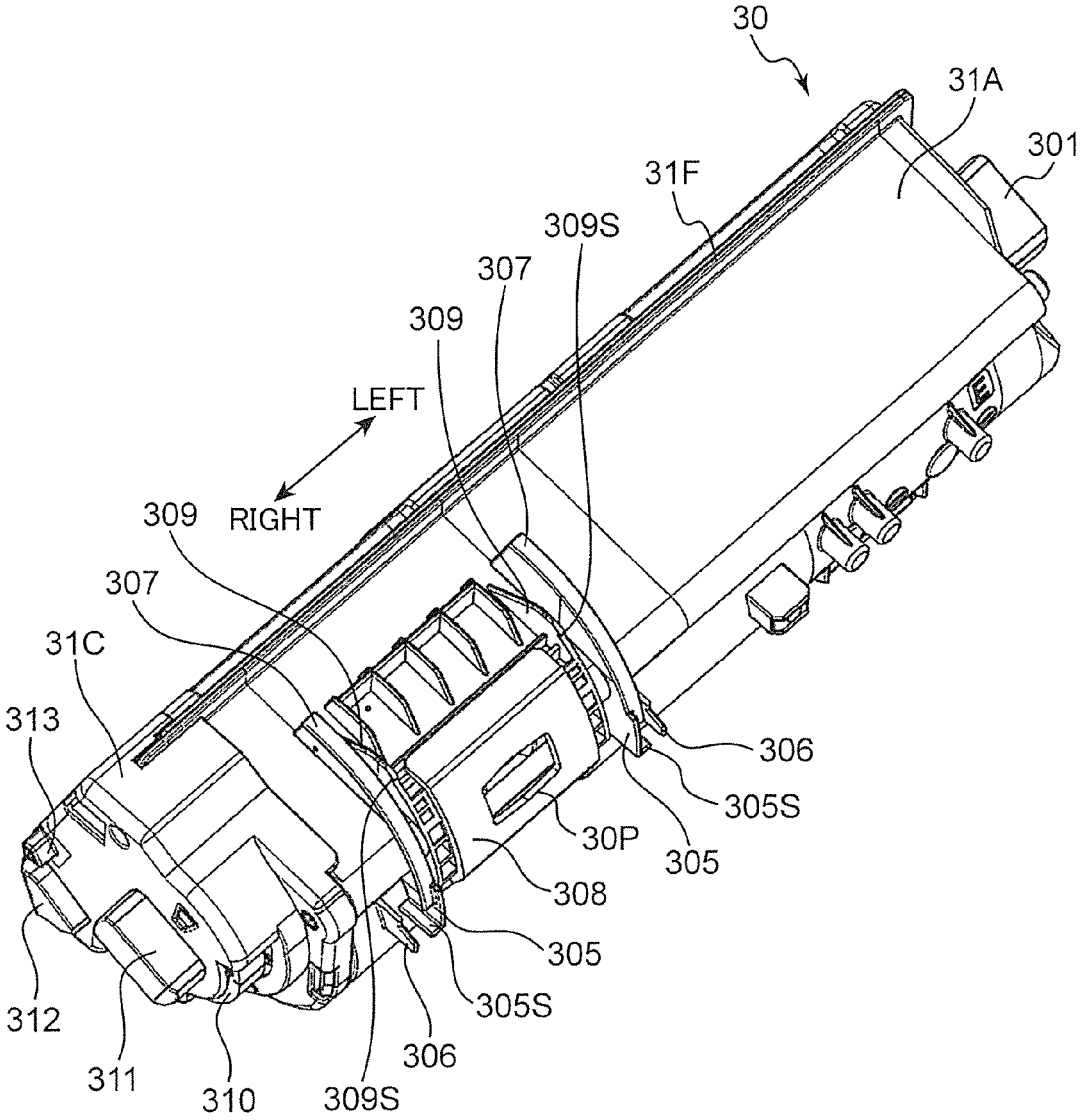
FIG. 12 is a perspective view of the developer container according to the embodiment of the present disclosure, with a shutter detached.
Figure 13A:
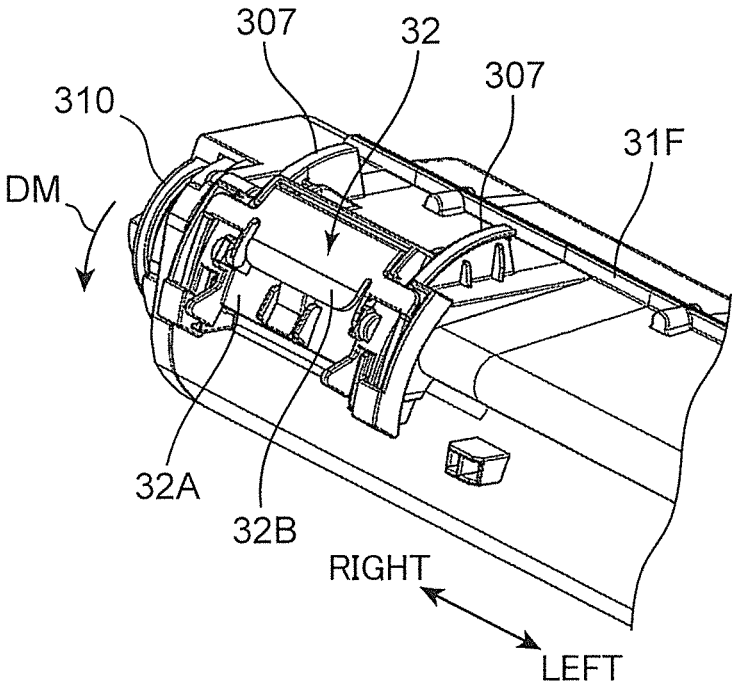
FIG. 13A is an enlarged perspective view of the developer container according to the embodiment of the present disclosure.
Figure 13B:
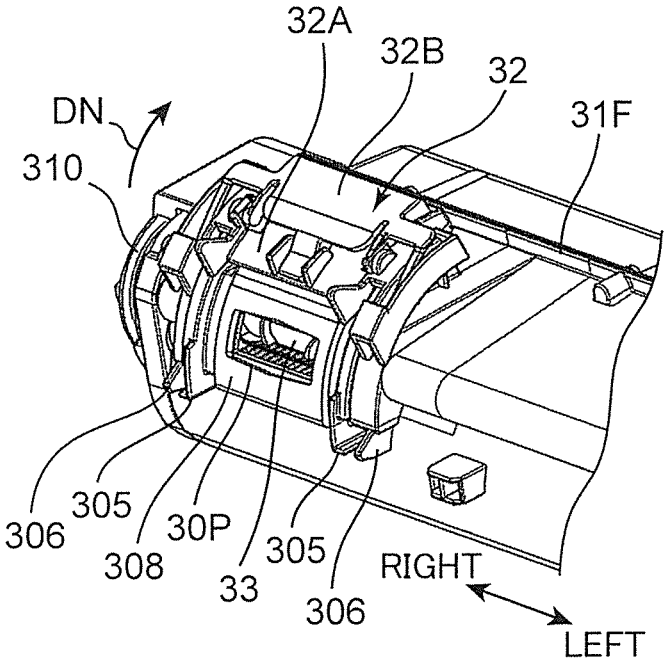
FIG. 13B is an enlarged perspective view of the developer container according to the embodiment of the present disclosure.
Figure 14A:
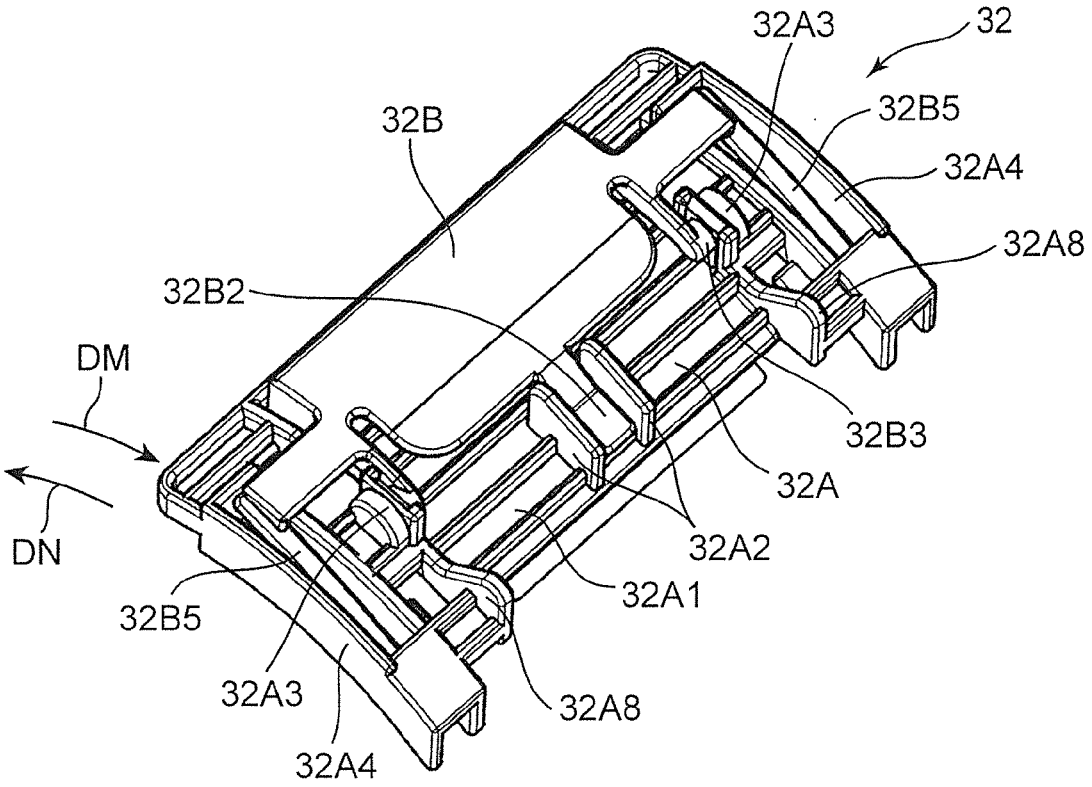
FIG. 14A is a perspective view of the shutter of the developer container according to the embodiment of the present disclosure.
Figure 14B:
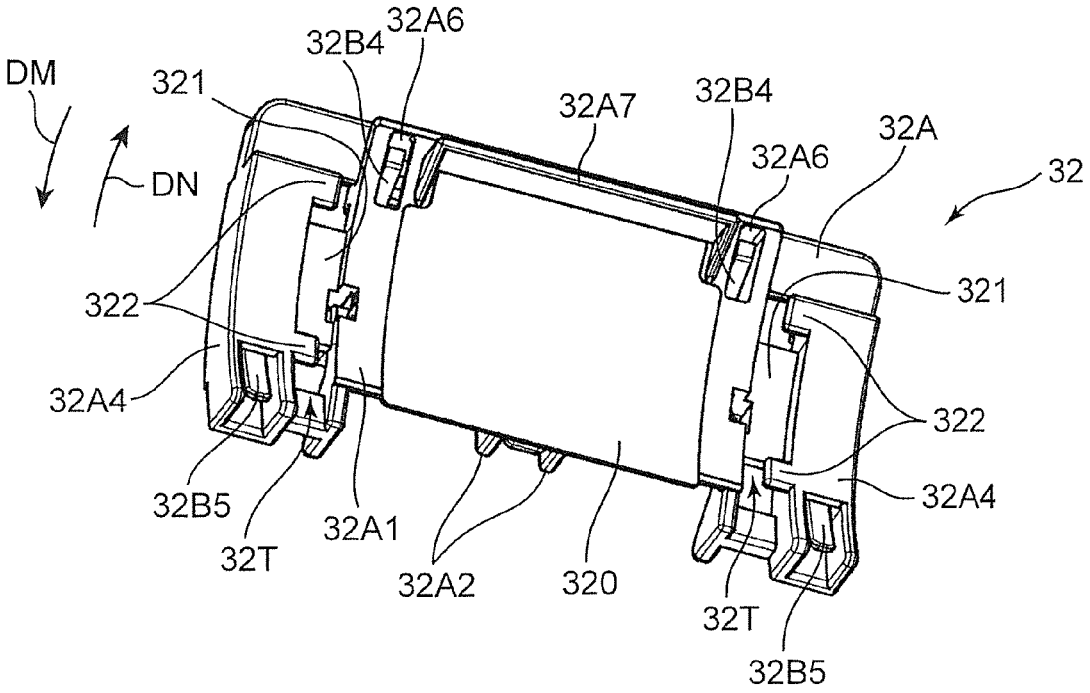
FIG. 14B is a perspective view of the shutter of the developer container according to the embodiment of the present disclosure.
Figure 15A:
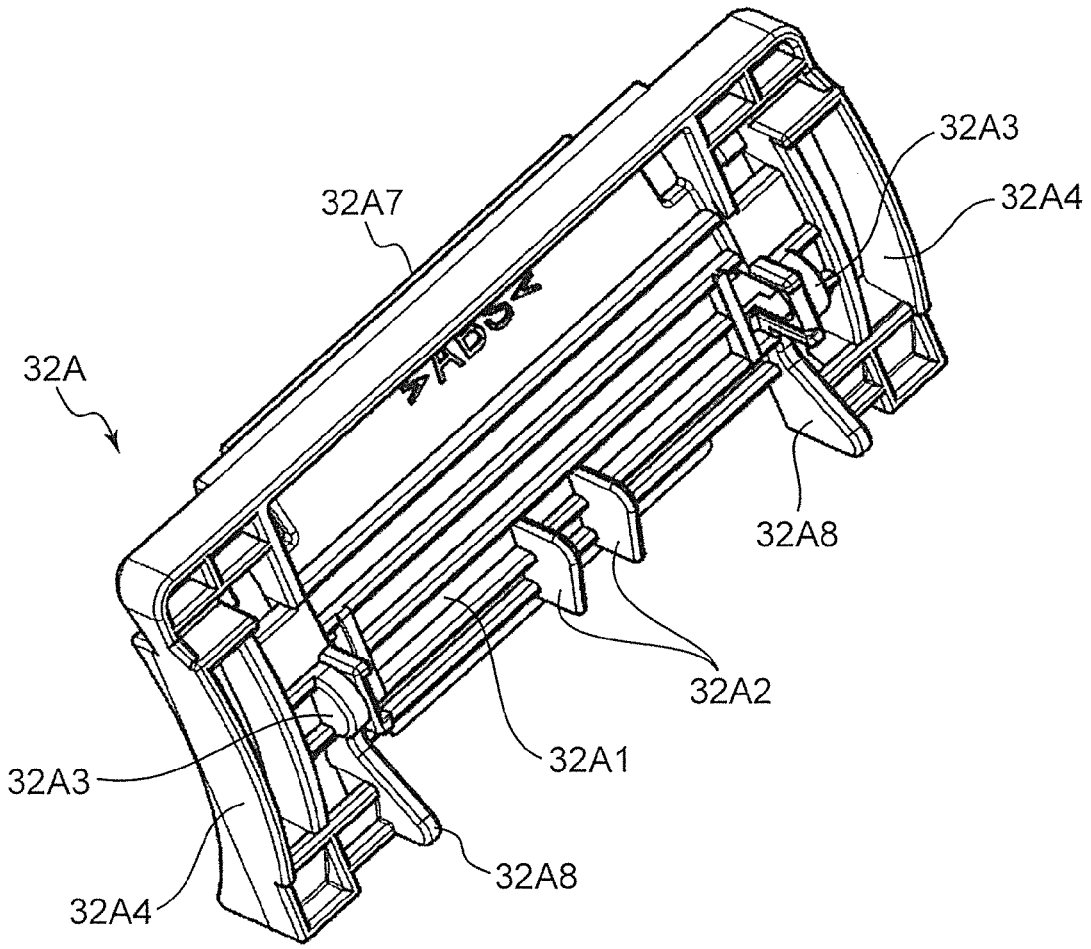
FIG. 15A is a perspective view of a shutter body of the developer container according to the embodiment of the present disclosure.
Figure 15B:
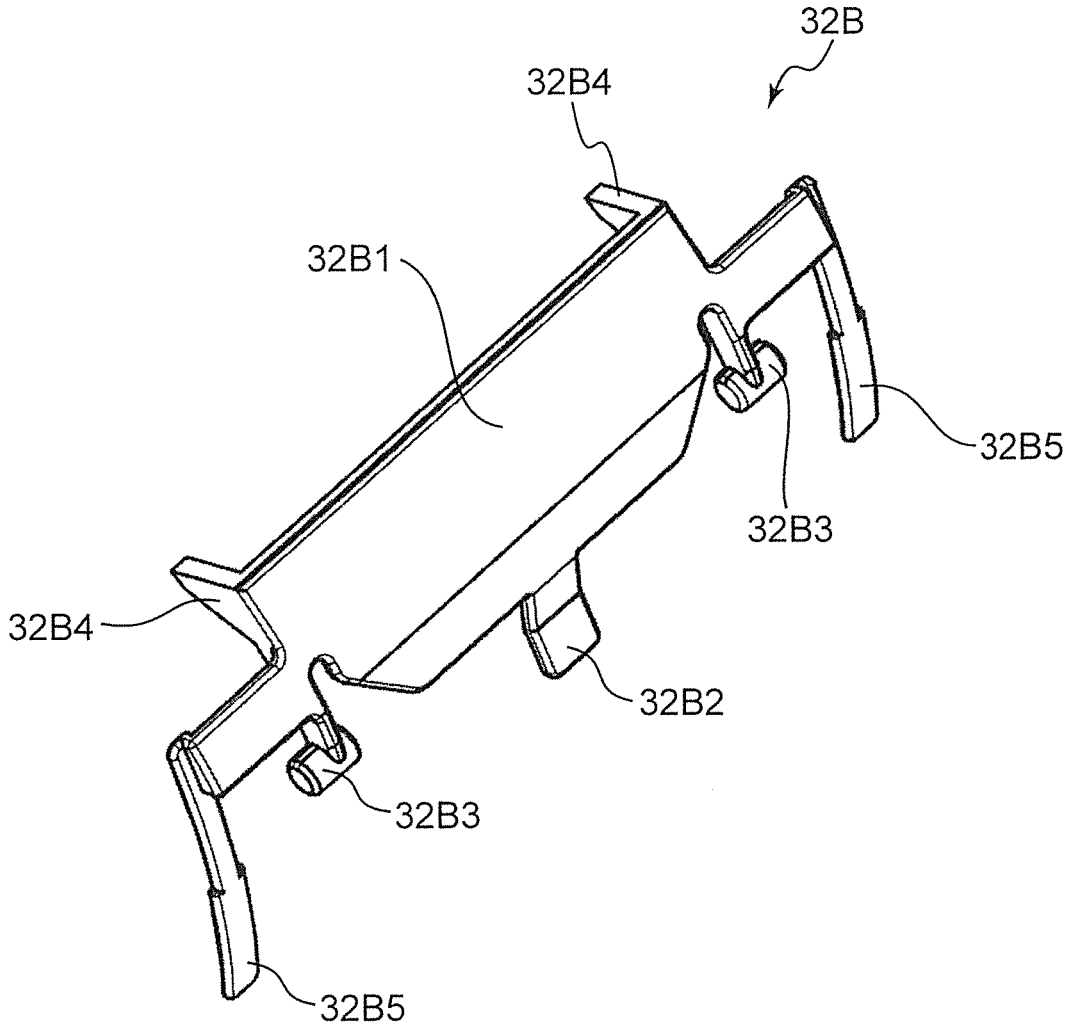
FIG. 15B is a perspective view of a stopper member of the developer container according to the embodiment of the present disclosure.
Figure 16A:
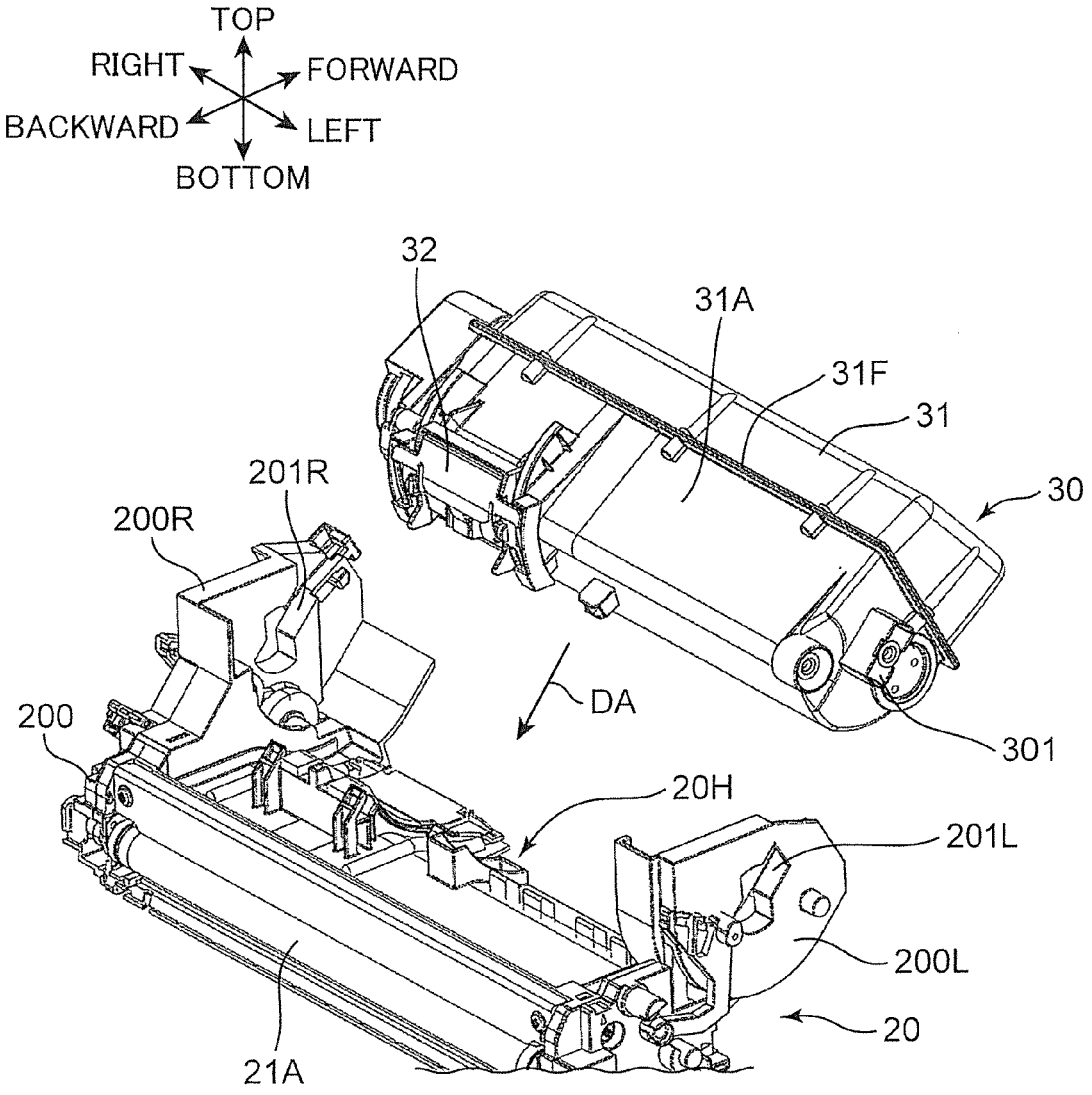
FIG. 16A is a perspective view illustrating mounting of the developer container onto the developing device in the embodiment of the present disclosure.
Figure 16B:
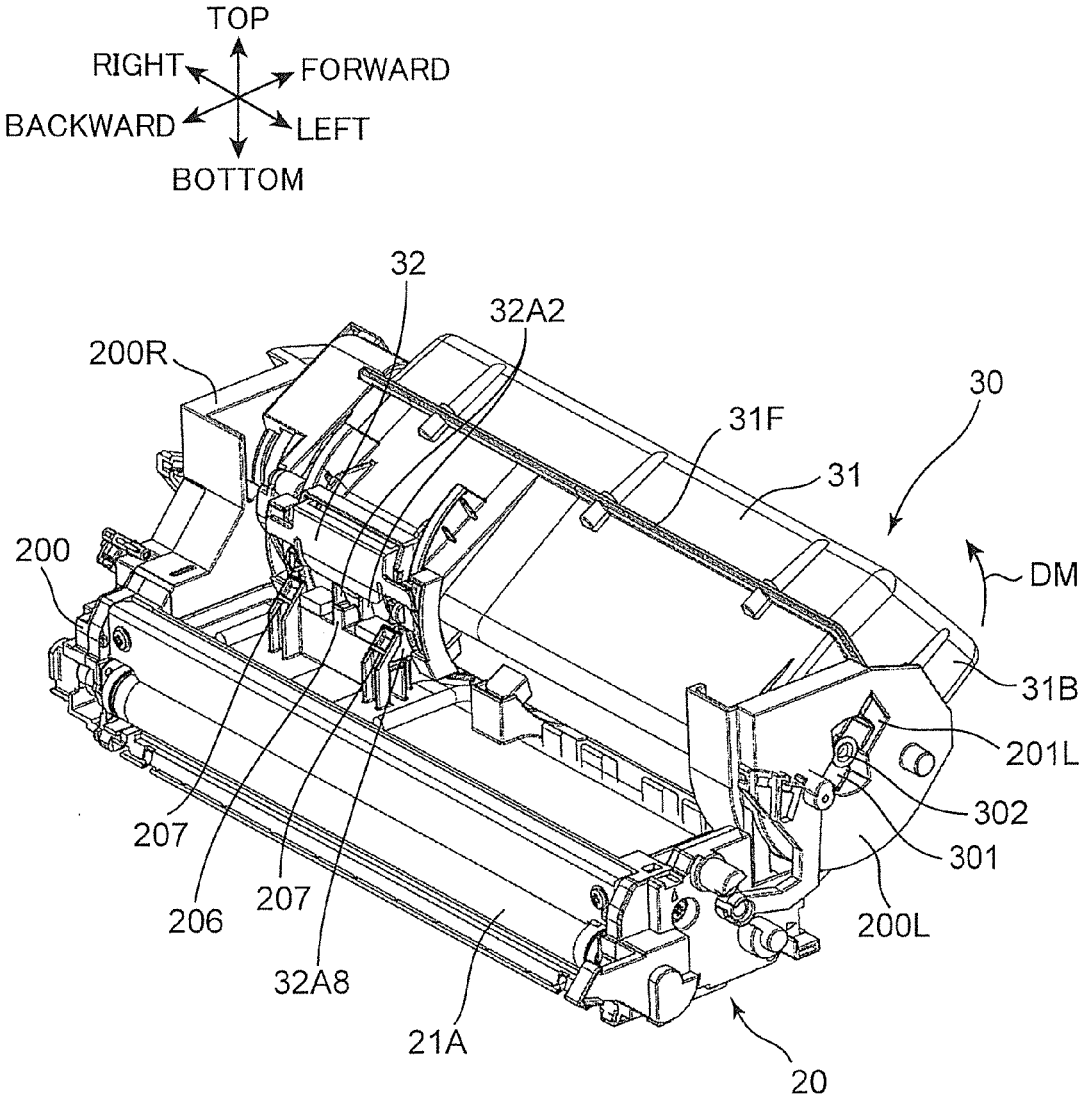
FIG. 16B is a perspective view illustrating the mounting of the developer container onto the developing device in the embodiment of the present disclosure.
Figure 16C:
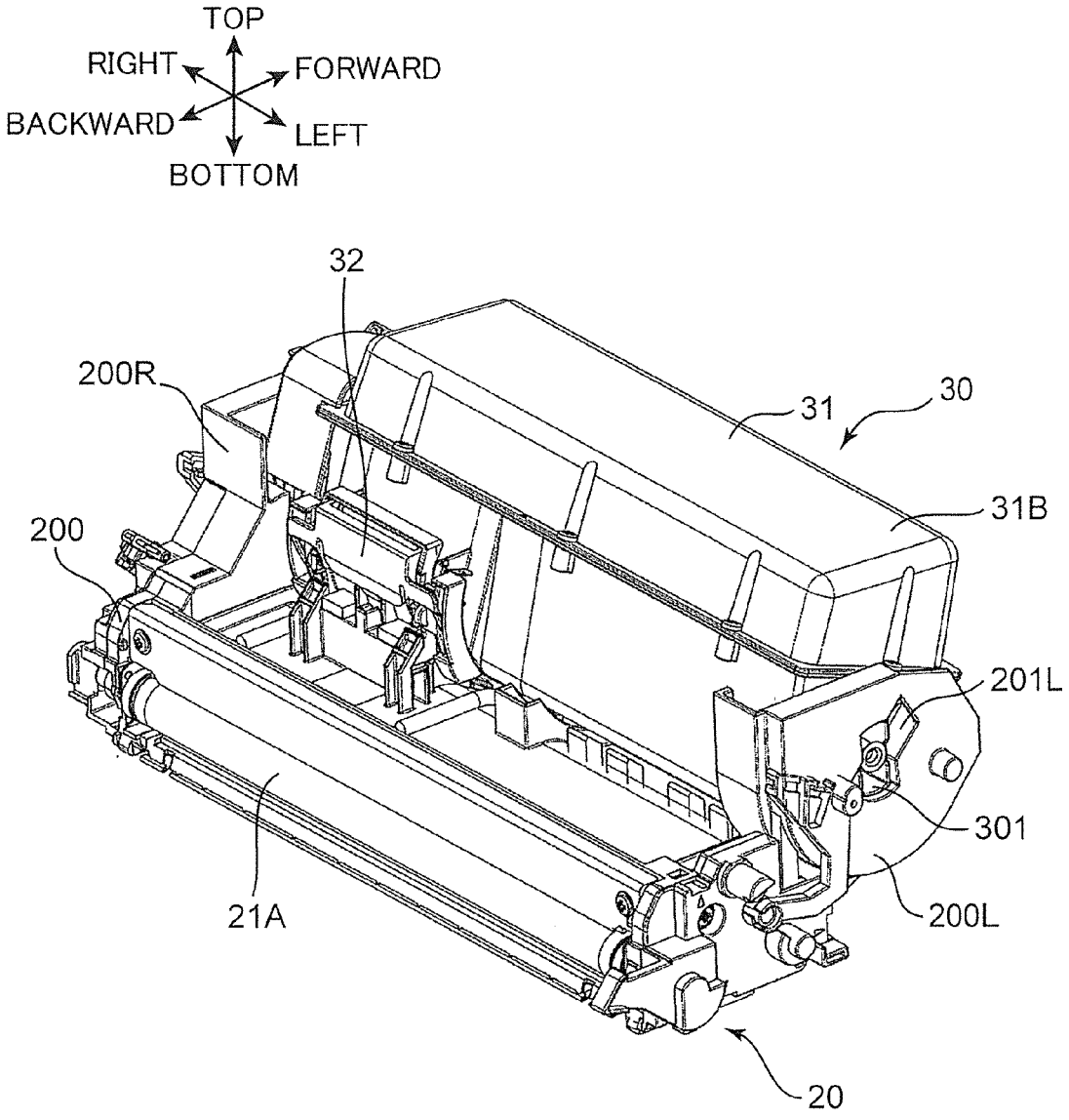
FIG. 16C is a perspective view illustrating the developer container mounted on the developing device in the embodiment of the present disclosure.

Now, the structures of the toner container 30 and the developing device 20 will be further described in detail. FIG. 11 is a perspective view of the toner container 30 according to the present embodiment. FIG. 12 is a perspective view of the toner container 30, with the container shutter 32 described later detached. FIGS. 13A and 13B are enlarged perspective views of the toner container 30, FIG. 13A showing a state where the toner discharge port 30P described later is covered by the container shutter 32, and FIG. 13B showing a state where the toner discharge port 30P is exposed. FIGS. 14A and 14B are perspective views of the container shutter 32 of the toner container 30 according to the present embodiment, FIG. 14A showing the container shutter 32 as seen from the outside of the toner container 30, and FIG. 14B showing the container shutter 32 as seen from the inside of the toner container 30. FIG. 15A is a perspective view of a shutter body 32A of the container shutter 32. FIG. 15B is a perspective view of a shutter stopper 32B of the container shutter 32. FIGS. 16A and 16B are perspective views illustrating the mounting of the toner container 30 onto the developing device 20. FIG. 16C is a perspective view illustrating the toner container 30 mounted on the developing device 20.

The toner container 30 has a longer dimension in one direction. The toner container 30 is mounted onto the developing device 20 disposed in the casing 101 in such a manner that the length of the toner container 30 extends in the left/right direction. The toner container 30 includes, in addition to the above-described container body 31, the container shutter 32 (FIG. 11), the toner discharge port 30P (FIG. 12) (developer discharge port), the left guide 301, a paddle bearing 302 (see FIG. 16B), a pair of container shutter pushing portions 305 (FIG. 12), a pair of elastic piece pushing portions 306 (FIG. 12), a pair of guide ribs 307 (FIG. 12), a discharge projection 308 (FIG. 12), a pair of container shutter locking ribs 309 (see FIG. 12), the transmission gear 310 (FIG. 12), the right guide 311 (FIG. 12), the first lock engaging portion 312, and the second lock engaging portion 313.

The toner discharge port 30P (FIG. 12) is formed at the lower right end of the body portion 31A. Specifically, the toner discharge port 30P is formed in a substantially rectangular shape in an outer portion of the discharge projection 308 (FIG. 12), the discharge projection 308 projecting in an arc shape from a lower surface of the body portion 31A. Toner contained in the toner container 30 is discharged through the toner discharge port 30P and supplied to the developing device 20.

The left guide 301 is in the form of a rectangular projection disposed on the left side of the body portion 31A and extending in a predetermined direction, the left guide 30 regulating the mounting direction (in the arrow DA direction shown in FIG. 16A) in which the toner container 30 is mounted onto the developing device 20. The left guide 301 has an internal cavity. The paddle bearing 302 (FIG. 16B) is disposed inside the left guide 301. The paddle bearing 302 rotatably and axially supports the container paddle 30K. A bearing similar to the paddle bearing 302 (FIG. 16B) disposed in the left guide 301 is also disposed inside the right guide 311, the bearing being disposed adjacent to the transmission gear 310 and axially supporting a shaft of the container paddle 30K.

The container shutter pushing portions 305 (FIG. 12) are in the form of a pair of projecting ribs, and sandwich the discharge projection 308 in the longitudinal direction (left/right direction) of the toner container 30, the discharge projection 308 being formed with the toner discharge port 30P. The container shutter pushing portions 305 are disposed downstream of the toner discharge port 30P in a rotational direction (first rotational direction or the direction of the arrow DM shown in FIG. 13A) in which the toner container 30 is mounted. The pair of container shutter pushing portions 305 each extend in the rotational direction and have respective distal ends (container shutter pushing pieces 305S) extending in the longitudinal direction of the toner container 30 (respectively extending in the left and right directions). The container shutter pushing pieces 305S have functions to push a main unit shutter 22 described later and to be pushed by the main unit shutter 22.

The elastic piece pushing portions 306 (FIGS. 12 and 13B) are in the form of a pair of thin projections extending from the body portion 31A and disposed adjacent to the container shutter pushing pieces 305S of the container shutter pushing portions 305. The pair of elastic piece pushing portions 306 sandwich the pair of container shutter pushing portions 305 in the left/right direction. The elastic piece pushing portions 306 extend in the above-mentioned rotational direction of the toner container 30 and have such a stepped shape that the height of projection increases in a direction away from the toner discharge port 30P. The elastic piece pushing portions 306 respectively face a pair of elastic pieces 32B5 of the shutter stopper 32B described later and have a function to push the corresponding elastic pieces 32B5.

The pair of guide ribs 307 (FIG. 12) project from the body portion 31A in an arc shape and respectively connect with the container shutter pushing portions 305. The guide ribs 307 extend in the rotational direction of the container body 31. The pair of guide ribs 307 sandwich the toner discharge port 30P in the left/right direction. Further, as shown in FIG. 12, the guide ribs 307 extend long in a direction away from the container shutter pushing pieces 305S, with respective distal ends facing the container flange 31F. Respective outer portions of the pair of guide ribs 307 are so bent as to have a predetermined width in the left/right direction. The guide ribs 307 support the container shutter 32 in such a way as to allow the container shutter 32 to slide around a specific axis.

The pair of container shutter locking ribs 309 (FIG. 12) extend from the left and right edges of the discharge projection 308 in the rotational direction of the toner container 30. More specifically, the pair of container shutter locking ribs 309 extend from the left and right edges of the discharge projection 308 in a rotational direction (second rotational direction or the direction of the arrow DN shown in FIG. 13B) in which the toner container 30 is dismounted from the developing device 20. The container shutter locking ribs 309 each have a stepped portion (container shutter engaging portion 309S) in the form of a pawl (FIG. 12). The container shutter engaging portions 309S are respectively engageable with stopper locking pieces 32B4 of the shutter stopper 32B described later.

The transmission gear 310 (FIGS. 11 and 12) is rotatably supported on the right surface of the toner container 30. The transmission gear 310 has a function to transmit a torque to the container paddle 30K. When the toner container 30 is mounted onto the developing device 20, an unillustrated development gear group of the developing device 20 is connected to the transmission gear 310 to input a torque to the transmission gear 310.

The first lock engaging portion 312 is disposed on the right surface of the container cover 31C at a distance from the right guide 311, and is in the form of a projection extending from the container cover 31C. The first lock engaging portion 312 has a substantially trapezoid shape in sectional view perpendicularly intersecting the left/right direction (see FIG. 20A). Similarly, the second lock engaging portion 313 is in the form of a projection extending from the container cover 31C. The second lock engaging portion 313 has a trapezoid shape smaller than the first lock engaging portion 312. The second lock engaging portion 313 is disposed at a distance from the first lock engaging portion 312 in the rotational direction of the toner container 30. The first lock engaging portion 312 and the second lock engaging portion 313 are engageable with the locking contact piece 202S (FIG. 5).

The container shutter 32 (FIG. 11) is supported on the container body 31 slidably with respect to the toner discharge port 30P, and covers or exposes the toner discharge port 30P (FIGS. 13A and 13B). At this time, the container shutter 32 slides along the guide ribs 307 (FIG. 12) of the container body 31. The container shutter 32 includes the shutter body 32A and the shutter stopper 32B. The shutter stopper 32B is pivotally supported on the shutter body 32A.

With reference to FIGS. 14A and 14B, the shutter body 32A is in the form of a substantially rectangular member having a curved surface extending along the circumference of the container body 31. The shutter body 32A covers the toner discharge port 30P. The shutter body 32A includes a shutter plate portion 32A1, a pair of release piece support portions 32A2, a pair of stopper axial support portions 32A3, a pair of elastic piece support portions 32A4, a pair of shutter holes 32A6 (FIG. 14B), a shutter contact portion 32A7, a pair of shutter engaging pieces 32A8, a container shutter sheet 320, a pair of guided surfaces 321, and a pair of guided pieces 322.

The shutter plate portion 32A1 constitutes the body of the shutter body 32A and is in the form of a substantially rectangular plate. The release piece support portions 32A2 are in the form of a pair of thin projections extending from a longitudinally central portion (in the left/right direction shown in FIG. 11) of the shutter plate portion 32A1, as shown in FIG. 14A. A stopper release piece 32B2 of the shutter stopper 32B described later lies between the pair of release piece support portions 32A2.

The stopper axial support portions 32A3 are in the form of a pair of bearings, and are disposed outside the pair of release piece support portions 32A2 in the longitudinal direction. The stopper axial support portions 32A3 respectively rotatably and axially support a pair of stopper support portions 32B3 described later. The elastic piece support portions 32A4 are in the form of a pair of grooves disposed outside the pair of stopper axial support portions 32A3 in the longitudinal direction. Each of the elastic piece support portions 32A4 is defined by a bottom plate flush with the shutter plate portion 32A1, and a pair of side walls. The elastic pieces 32B5 described later are respectively placed in the elastic piece support portions 32A4.

With reference to FIG. 14B, the pair of shutter holes 32A6 have a long narrow shape and extend through the shutter plate portion 32A1. The shutter holes 32A6 are formed at an upstream end of the shutter plate portion 32A1 in the second rotational direction (in the direction of the arrow DN shown in FIG. 14B). The shutter contact portion 32A7 is in the form of a long and thin projection extending between the pair of shutter holes 32A6, and has longitudinally opposite ends extending downstream in the first rotational direction (in the direction of the arrow DM shown in FIG. 14B). The shutter contact portion 32A7 has a function to restrict the movement of the container shutter 32 in the second rotational direction. The shutter engaging pieces 32A8 (FIG. 14A) are in the form of a pair of thin projections and are disposed respectively between the shutter plate portion 32A1 and the pair of elastic piece support portions 32A4 in the longitudinal direction. The shutter engaging pieces 32A8 have a substantially triangular shape. The shutter engaging pieces 32A8 are respectively engageable with a pair of container shutter fastening portions 207 of the developing device 20 described later.

The container shutter sheet 320 is adhered to the surface of the shutter body 32A of the container shutter 32 that covers the toner discharge port 30P. In the present embodiment, the container shutter sheet 320 is made of a resin film.

With reference to FIG. 14B, the guided surfaces 321 are disposed respectively between the shutter plate portion 32A1 and the pair of elastic piece support portions 32A4 and at a different level from the shutter plate portion 32A1 and the elastic piece support portions 32A4. Each of the guided pieces 322 consists of a pair of projections extending from the bottom surface of the elastic piece support portion 32A4 respectively to the upstream and downstream sides of the guided surface 321 in the first rotational direction. A space is defined between each of the guided surfaces 321 and each of the guided pieces 322, the space extending in the first rotational direction (in the direction of the arrow DM). Respective one ends of the guide ribs 307 (FIG. 12) of the toner container 30 are inserted into the spaces respectively through guide insertion openings 32T shown in FIG. 14B, whereby the container shutter 32 is attached to the container body 31. As a result, the container shutter 32 is slidable on the container body 31.

The shutter stopper 32B (stopper member) is attached to the surface of the shutter body 32A opposite to the surface that covers the toner discharge port 30P. The shutter stopper 32B has a function to restrict or permit the sliding movement of the container shutter 32. With reference to FIGS. 15A and 15B, the shutter stopper 32B includes a stopper plate 32B1, the stopper release piece 32B2, the pair of stopper support portions 32B3, the pair of stopper locking pieces 32B4, and the pair of elastic pieces 32B5.

The stopper plate 32B1 constitutes the body of the shutter stopper 32B, and has a substantially rectangular shape. The stopper release piece 32B2 is in the form of a thin projection extending from a longitudinally central portion (in the left/right direction shown in FIG. 11) of the stopper plate 32B1. As shown in FIG. 14A, the stopper release piece 32B2 projects from the stopper plate 32B1 downstream in the first rotational direction. Further, as mentioned above, the stopper release piece 32B2 is disposed between the pair of release piece support portions 32A2 of the shutter body 32A.

The stopper support portions 32B3 are in the form of a pair of thin projections provided near the longitudinally opposite ends of the stopper plate 32B1, each of the projection including a distal end having a shaft slightly projecting therefrom. The shafts of the stopper support portions 32B3 are respectively inserted into the stopper axial support portions 32A3 of the shutter body 32A mentioned above to be axially supported. Consequently, the shutter stopper 32B is pivotable with respect to the shutter body 32A about an axis connecting the pair of stopper support portions 32B3.

The stopper locking pieces 32B4 are in the form of a pair of thin projections extending from the longitudinally opposite ends of the stopper plate 32B 1. As shown in FIG. 15B, the stopper locking pieces 32B4 have a substantially triangular shape. The stopper locking pieces 32B4 respectively connect with the stopper support portions 32B3 in the first rotational direction. The stopper locking pieces 32B4 are respectively engageable with the container shutter engaging portions 309S of the container body 31. The stopper release piece 32B2 and the stopper locking pieces 32B4 are disposed at mutually opposite sides of the stopper support portions 32B3.

The elastic pieces 32B5 are in the form of a pair of long and thin projections provided at the longitudinally opposite ends of the shutter stopper 32B. Each of the elastic pieces 32B5 has a free distal end extending in the first rotational direction.

When the pair of stopper support portions 32B3 are inserted into the pair of stopper axial support portions 32A3 so that the shutter body 32A and the shutter stopper 32B constitute an integral structure, the pair of stopper locking pieces 32B4 enter the shutter holes 32A6 (FIG. 14B). Further, the pair of elastic pieces 32B5 are placed into the elastic piece support portions 32A4. At this time, respective distal ends of the elastic pieces 32B5 are exposed on the backside of the container shutter 32, as shown in FIG. 14B.

With reference to FIGS. 16A and 16B, the developing device 20 includes a container mounting section 20H (mounting section) defined between the housing right wall 200R and the housing left wall 200L. The toner container 30 is mounted in the container mounting section 20H.

Further, the development housing 200 includes a stopper pushing portion 206 (FIG. 16B), the pair of container shutter fastening portions 207, and a pair of shutter springs 208 (FIG. 5).

The stopper pushing portion 206 (FIG. 16B) is in the form of a projection extending from a ceiling plate of the development housing 200 and disposed behind and adjacent to the toner supply port 204. The stopper pushing portion 206 has a function to push the stopper release piece 32B2 (FIG. 14A) of the container shutter 32 of the toner container 30 when the toner container 30 is mounted into the container mounting section 20H. In other words, the stopper pushing portion 206 permits the sliding movement of the container shutter 32.

The pair of container shutter fastening portions 207 (FIG. 16B) are in the form of projections extending from the ceiling plate of the development housing 200 and sandwich the stopper pushing portion 206 in the left/right direction. Each of the container shutter fastening portions 207 has a substantially trapezoid shape in sectional view perpendicularly intersecting the left/right direction. Further, each container shutter fastening portion 207 has a wedge-shaped cutout formed in a front lateral portion thereof. The shutter engaging pieces 32A8 (FIG. 14A) of the container shutter 32 of the toner container 30 respectively engage with the cutouts when the toner container 30 is mounted in the container mounting section 20H. As a result, the container shutter fastening portions 207 secure the container shutter 32 to thereby restrict the movement (circular movement) of the container shutter 32.

The pair of shutter springs 208 (FIG. 5) are disposed outside the pair of container shutter fastening portions 207 in the left/right direction. The shutter springs 208 extend in the forward/backward direction. Respective one ends of the shutter springs 208 are fastened to the ceiling plate of the development housing 200. Further, the respective other ends of the shutter springs 208 are fastened to the main unit shutter 22 (FIG. 5).

Further, the developing device 20 includes the main unit shutter 22 (FIG. 5). The main unit shutter 22 is supported on the development housing 200 slidably with respect to the toner supply port 204. The main unit shutter 22 covers or exposes the toner supply port 204.

The above-mentioned shutter springs 208 bias the main unit shutter 22 in the direction of allowing the main unit shutter 22 to cover the toner supply port 204 (FIG. 5). Therefore, as shown in FIG. 16A, in the state that the toner container 30 is dismounted from the developing device 20, the main unit shutter 22 covers the toner supply port 204 owing to the biasing force of the shutter springs 208.

<Mounting and Dismounting of Toner Container onto and from Developing Device>

Now, the mounting of the toner container 30 onto the developing device 20 will be described with reference to FIGS. 17 to 22B in addition to FIGS. 16A to 16C.

Figure 17:
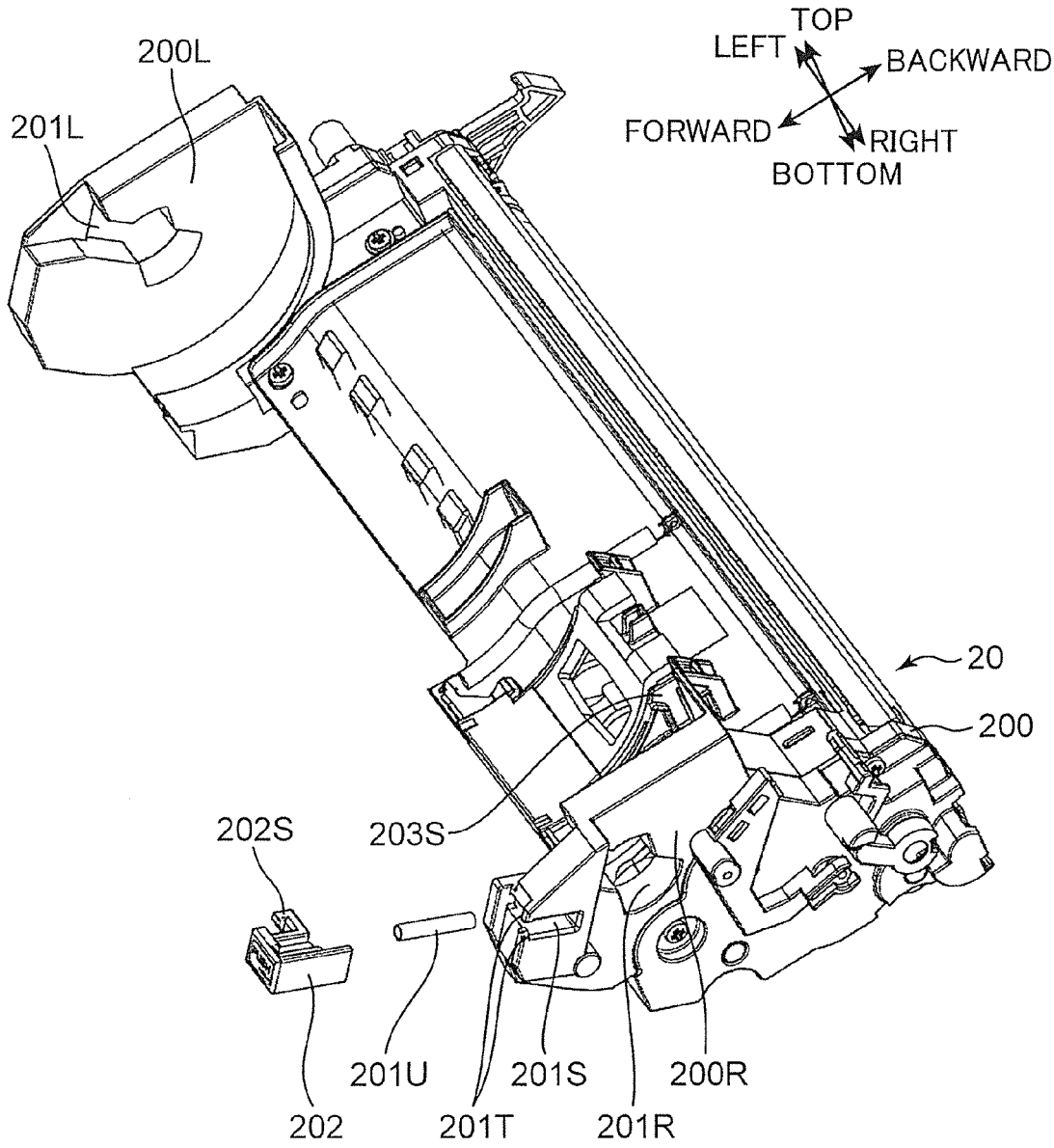
FIG. 17 is an exploded perspective view of the developing device according to the embodiment of the present disclosure.
Figure 18A:
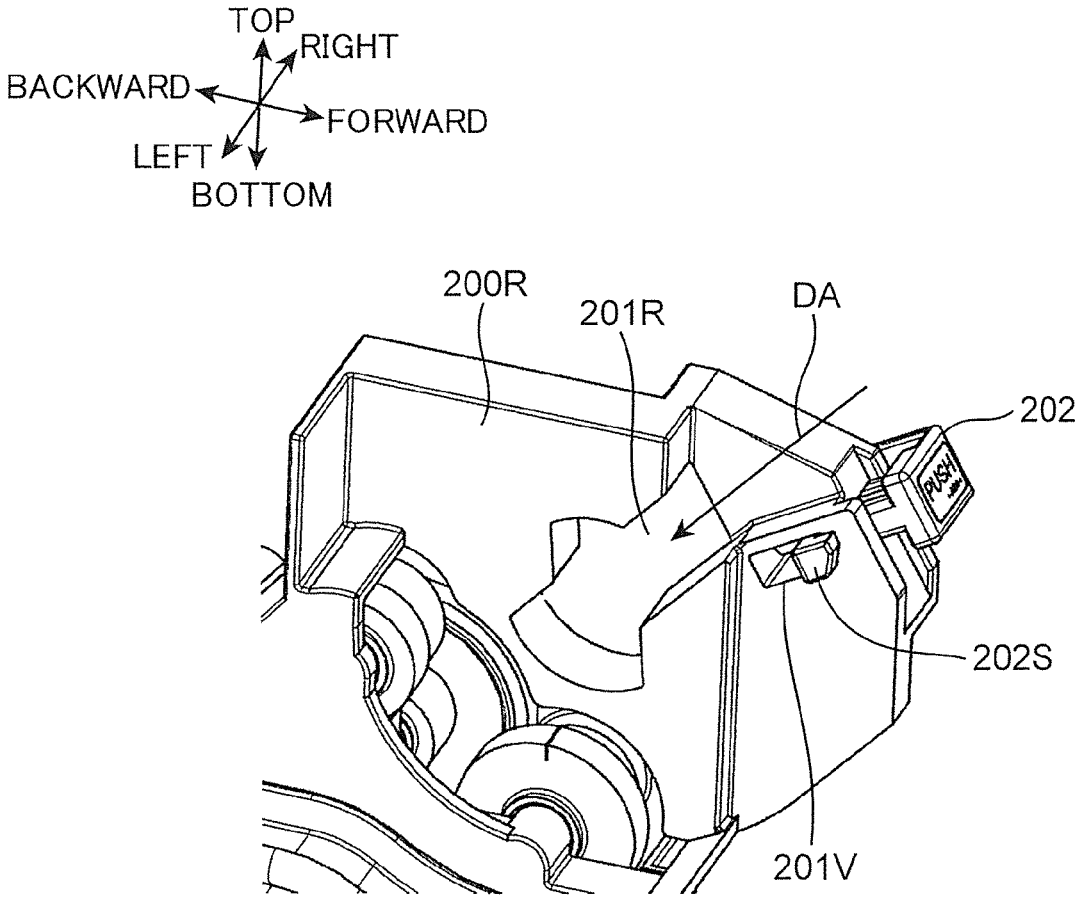
FIG. 18A is an enlarged perspective view of a portion of the developing device according to the embodiment of the present disclosure.
Figure 18B:
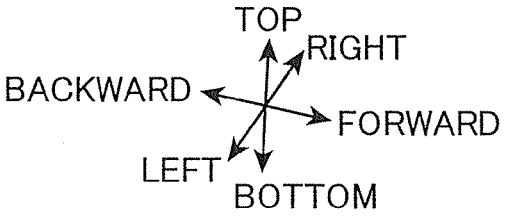
FIG. 18B is an enlarged perspective view of a portion of the developing device according to the embodiment of the present disclosure.
Figure 18B:
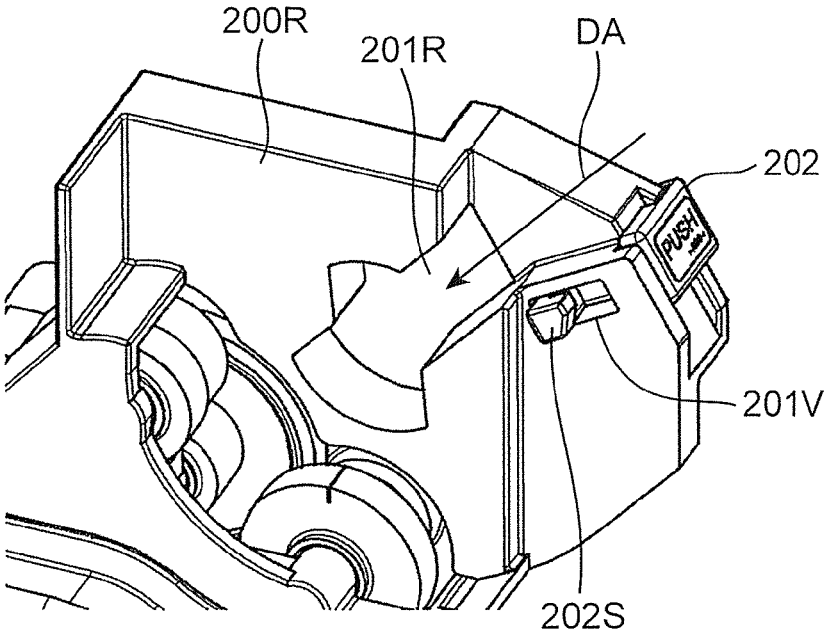
Figure 19:
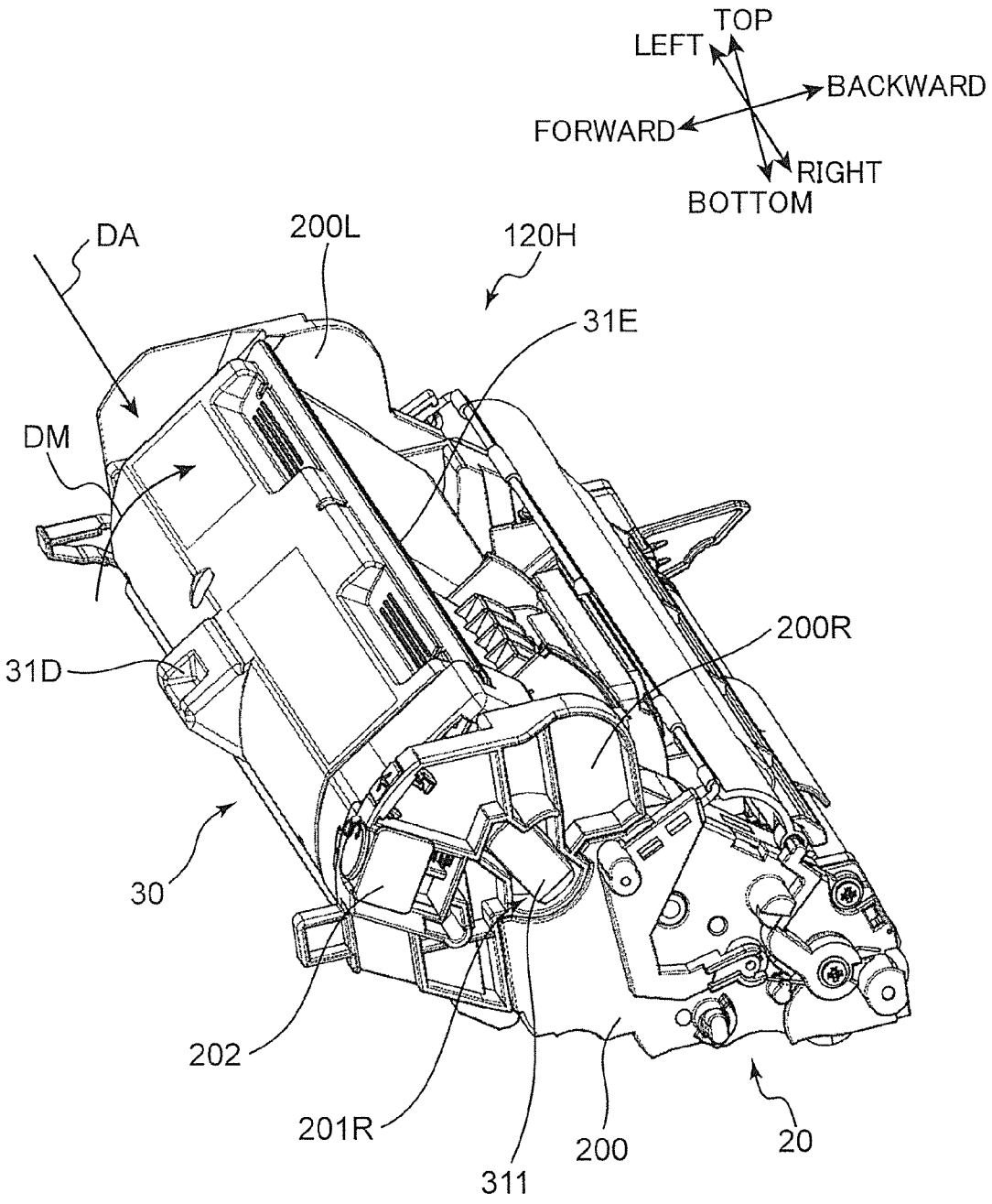
FIG. 19 is a perspective view illustrating the mounting of the developer container onto the developing device in the embodiment of the present disclosure.
Figure 20A:
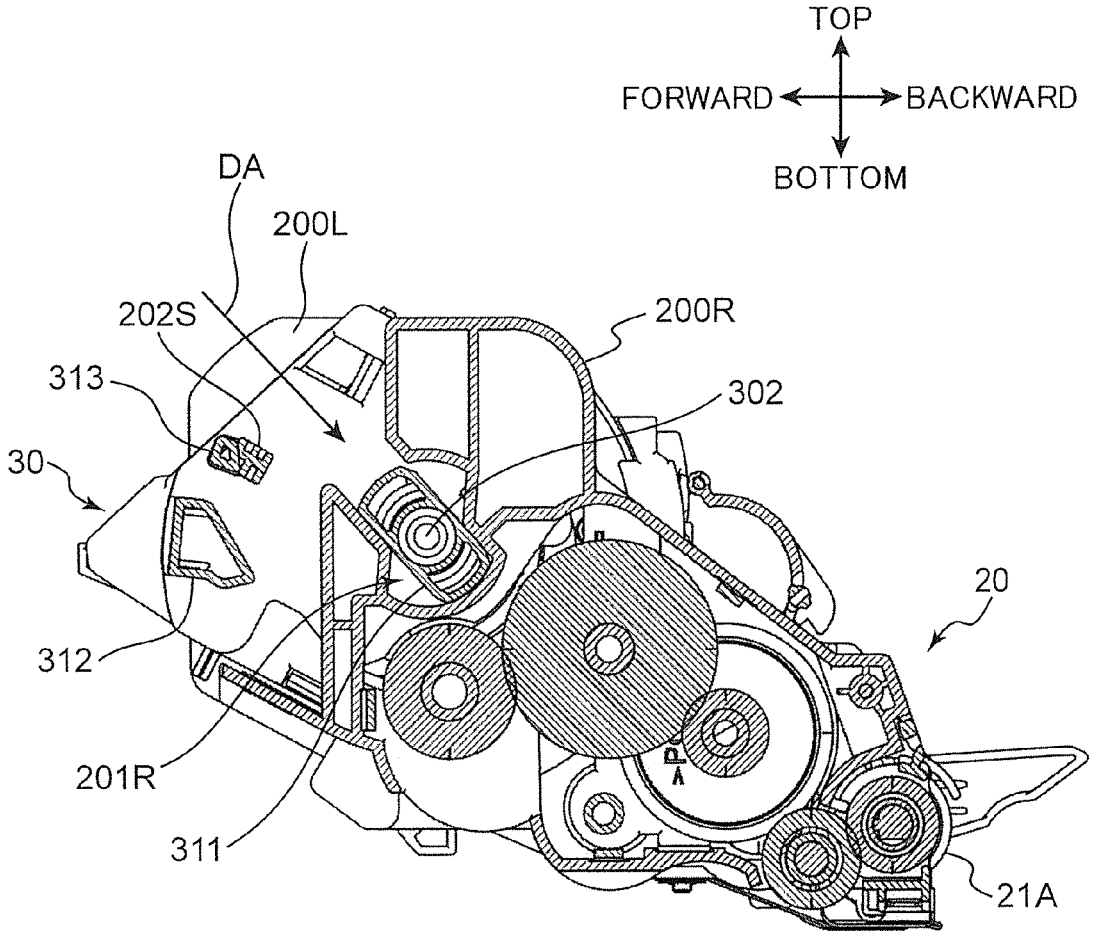
FIG. 20A is a sectional view illustrating the mounting of the developer container onto the developing device in the embodiment of the present disclosure.
Figure 20B:
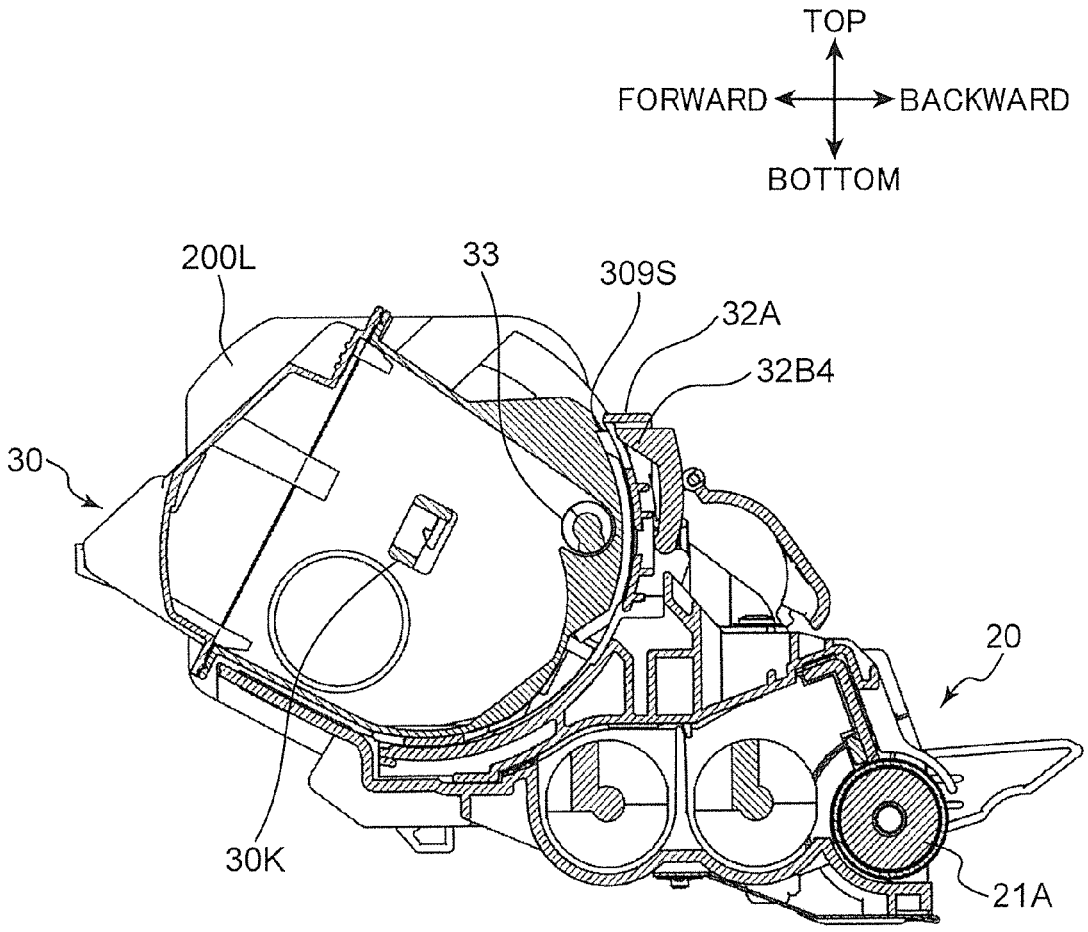
FIG. 20B is a sectional view illustrating the mounting of the developer container onto the developing device in the embodiment of the present disclosure.
Figure 20C:
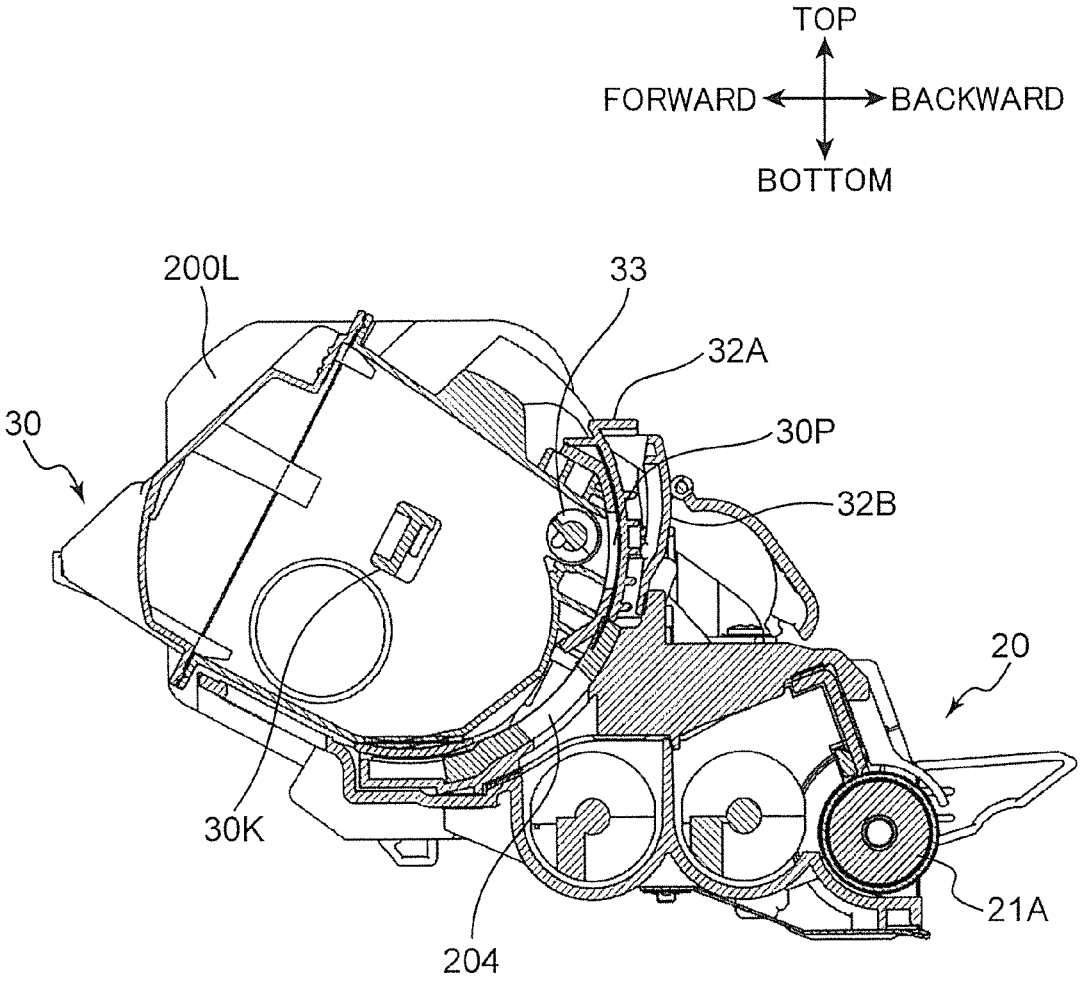
FIG. 20C is a sectional view illustrating the mounting of the developer container onto the developing device in the embodiment of the present disclosure.
Figure 21:
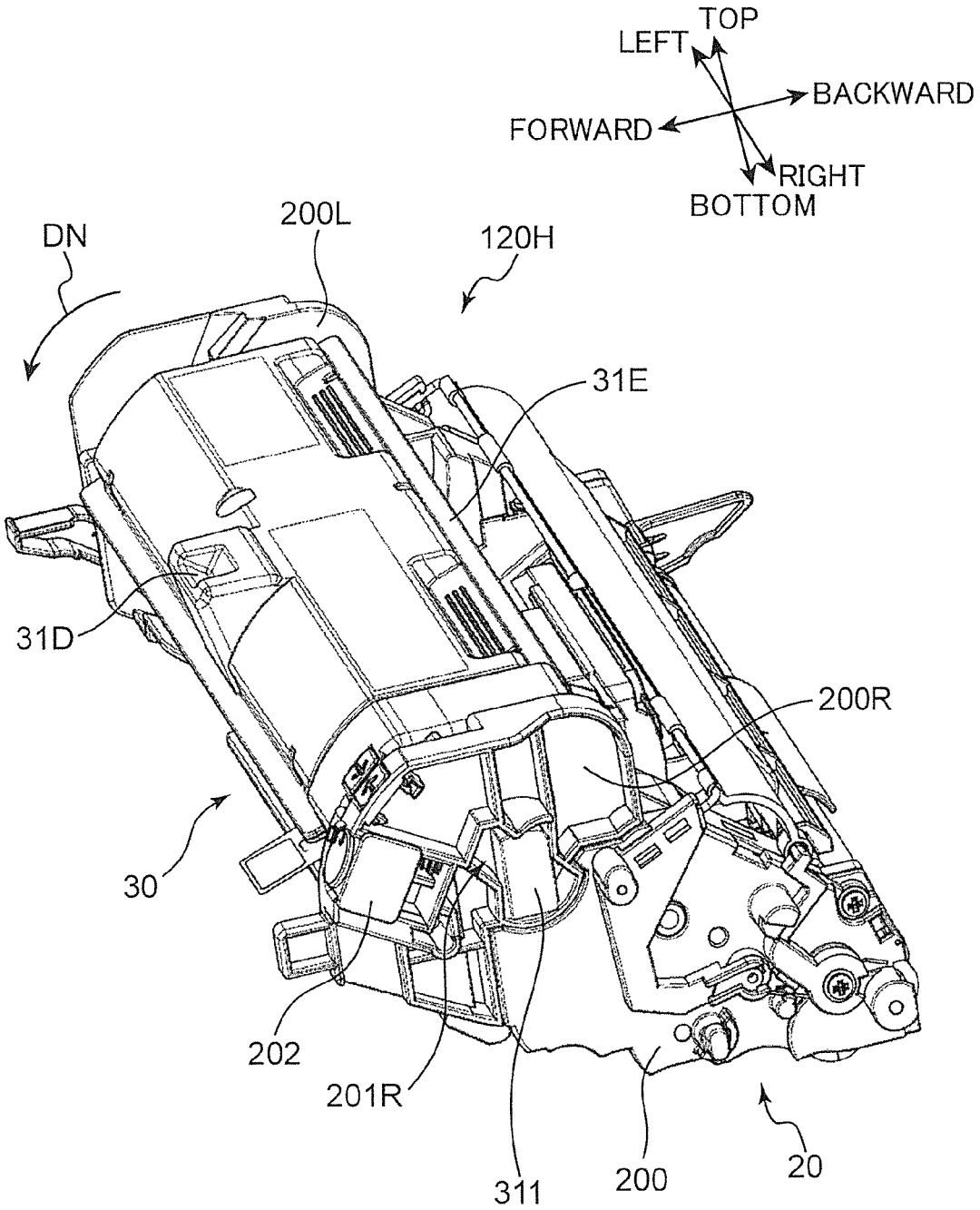
FIG. 21 is a perspective view illustrating the developer container mounted on the developing device in the embodiment of the present disclosure.
Figure 22A:
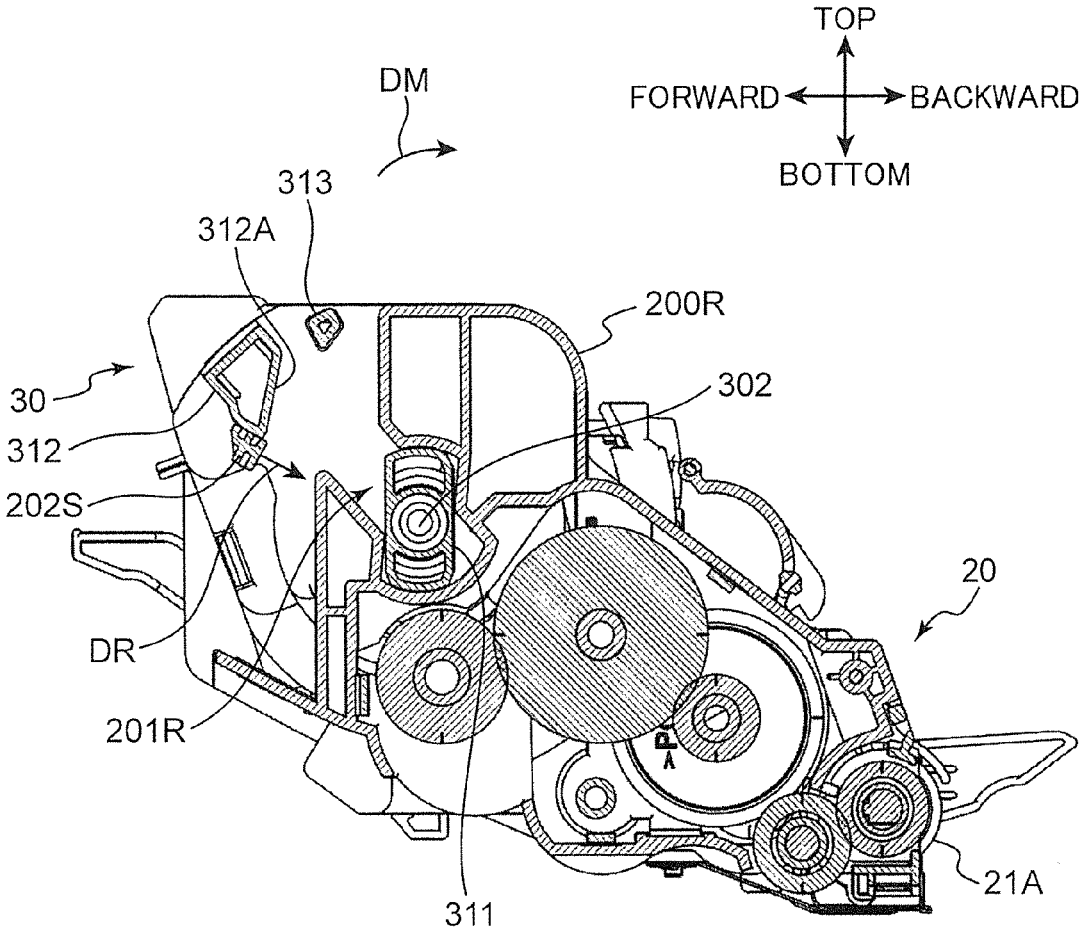
FIG. 22A is a sectional view of the developer container mounted on the developing device according to the embodiment of the present disclosure.
Figure 22B:
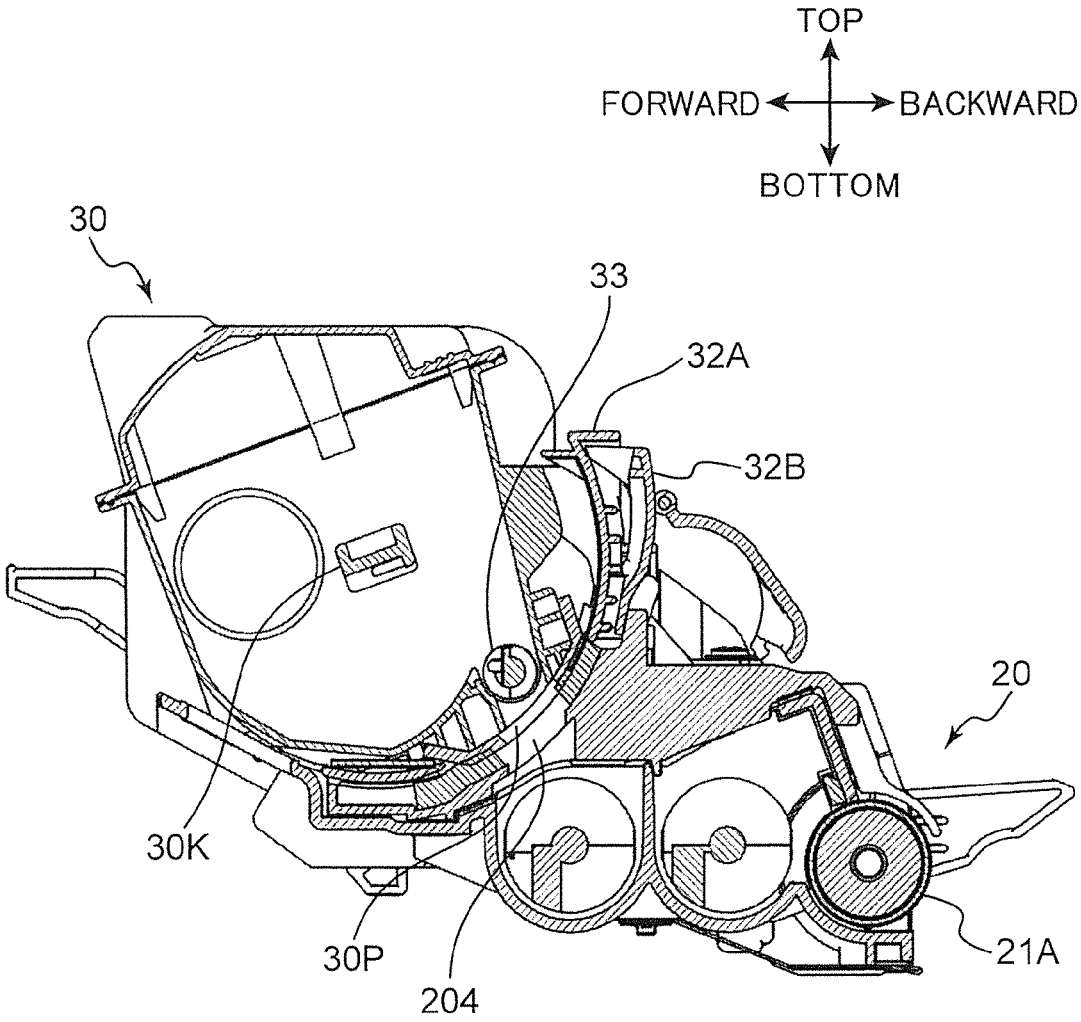
FIG. 22B is a sectional view of the developer container mounted on the developing device according to the embodiment of the present disclosure.

FIG. 17 is an exploded perspective view of the developing device 20 according to the present embodiment, with the lock button 202 and a lock biasing spring 201U being separated from the development housing 200. FIGS. 18A and 18B are enlarged perspective views of a portion (a portion around the housing right wall 200R of the development housing 200) of the developing device 20. FIG. 19 is a perspective view illustrating the mounting of the toner container 30 onto the developing device 20. FIGS. 20A to 20C are sectional views illustrating the mounting of the toner container 30 onto the developing device 20. FIGS. 20A, 20B, and 20C show different cross-sections in the longitudinal direction of the developing device 20. FIG. 21 is a perspective view illustrating the toner container 30 mounted on the developing device 20. FIGS. 22A and 22B are sectional views of the developing device 20 in the state shown in FIG. 21.

With reference to FIG. 17, the housing right wall 200R of the development housing 200 includes a lock guide groove 201S and a pair of lock engaging pieces 201T. The lock guide groove 201S is formed in a portion of the housing right wall 200R that is in front of the right guide groove 201R. The lock engaging pieces 201T are in the form of a pair of projections formed at a front lateral portion of the housing right wall 200R and extending into the lock guide groove 201S. Further, the developing device 20 includes the lock biasing spring 201U. The lock biasing spring 201U is in the form of a coil spring and disposed in the lock guide groove 201S to bias the lock button 202 forward. The above-mentioned locking contact piece 202S is in the form of a projection extending leftward from the lock button 202. The locking contact piece 202S has a function to lock the toner container 30 in each posture. Further, the lock button 202 has a function to release the locking of the toner container 30.

Further, with reference to FIG. 18A, a guide opening 201V is formed in a left portion of the housing right wall 200R. The guide opening 201V is a long hole extending in a direction slightly intersecting the mounting direction (in the direction of the arrow DA shown in FIG. 18A) of the toner container 30. The lock button 202 is pushed into the lock guide groove 201S while resiliently compressing the lock biasing spring 201U, with the locking contact piece 202S going into the guide opening 201V. At this time, the lock button 202 stops with a front end thereof slightly projecting frontward out of the housing right wall 200R owing to the biasing force of the lock biasing spring 201U. The lock button 202 is prevented from disengagement owing to the lock engaging pieces 201T (FIG. 17). The user pushes the lock button 202 against the biasing force of the lock biasing spring 201U to move the locking contact piece 202S from the front end to the rear end of the guide opening 201V, as shown in FIG. 18B.

As mentioned above, in the present embodiment, the toner container 30 can be independently mounted onto and dismounted from the developing device 20 in the state that the developing device 20 is mounted in the casing 101. Therefore, it is possible to easily replace the toner container 30 when it is empty. Before the toner container 30 is mounted on the developing device 20, if the container shutter 32 accidentally slides from the position of covering the toner discharge port 30P, toner will leak through the toner discharge port 30P. In the present embodiment, the container shutter 32 is prevented from sliding with respect to the toner discharge port 30P when the toner container 30 is independent.

Specifically, as shown in FIG. 13A, when the container shutter 32 covers the toner discharge port 30P, the stopper locking pieces 32B4 (FIG. 14B) passing through the shutter holes 32A6 are engaged with the container shutter engaging portions 309S (FIG. 12) of the container shutter locking ribs 309 of the container body 31. Further, the distal ends of the elastic pieces 32B5 (FIG. 14B), which are exposed from the elastic piece support portions 32A4 on the backside of the container shutter 32, respectively face the elastic piece pushing portions 306 (FIG. 12). When the stopper release piece 32B2 (FIG. 14A) is accidentally pushed, the elastic pieces 32B5 are slightly biased radially outward of the toner container 30 by the elastic piece pushing portions 306 to be elastically deformed. Because the distal ends of the elastic pieces 32B5 are thus biased and elastically deformed, a moment (biasing force) acts on the shutter stopper 32B (FIG. 14A) in the direction that brings the stopper locking pieces 32B4 into strong engagement with the container shutter engaging portions 309S (FIG. 12), with the pair of stopper support portions 32B3 acting as a fulcrum. Therefore, the container shutter 32 is prevented, owing to the elastic force of the elastic pieces 32B5, from sliding along the guide ribs 307 when the toner container 30 is stored or transported independently. Consequently, the toner discharge port 30P is reliably covered by the container shutter 32 (FIG. 11).

With reference to FIG. 19 and FIGS. 20A to 20C, the user of the printer 100 mounts the toner container 30 onto the developing device 20 disposed in the casing 101 in the open state of the front cover 106. At this time, the user can easily hold the toner container 30 by hooking the index finger and the middle finger around the second holder part 31E formed on an upper portion of the toner container 30 and hooking the thumb on the first holder part 31D of the toner container 30, the holder parts 31D, 31E being shown in FIG. 19. The user inserts the left guide 301 and the right guide 311 of the toner container 30 into the left guide groove 201L and the right guide groove 201R, respectively, to thereby mount the toner container 30 in the container mounting section 20H while being guided by the left guide groove 201L and the right guide groove 201R (FIGS. 19 and 20A to 20C) in the mounting direction (in the direction of the arrow DA shown in FIG. 19). The posture of the toner container 30 shown in FIGS. 19 and 20A to 20C is defined as a second posture (insertion posture) of the present disclosure. In this posture, the toner discharge port 30P of the toner container 30 lies above the toner supply port 204 of the developing device 20 and, therefore, the toner discharge port 30P does not communicate with the toner supply port 204 (FIG. 20C) yet.

At this time, as shown in FIG. 16B, the stopper pushing portion 206 of the development housing 200 pushes the stopper release piece 32B2 (FIG. 14A) disposed between the pair of release piece support portions 32A2. Consequently, the shutter stopper 32B pivots on the pair of stopper support portions 32B3, so that the pair of stopper locking pieces 32B4 respectively disengage from the container shutter engaging portions 309S (FIG. 20B). As a result, the container shutter 32 is released from the shutter stopper 32B and becomes slidable with respect to the container body 31.

On the other hand, when the toner container 30 is mounted in the container mounting section 20H in the insertion posture shown in FIG. 19, the pair of shutter engaging pieces 32A8 (FIG. 14A) of the container shutter 32 engage with the wedge-shaped cutouts of the container shutter fastening portions 207 (FIG. 16B). As a result, the container shutter 32 is secured to the container shutter fastening portions 207. Thereafter, the user rotates the container body 31 of the toner container 30 from the insertion posture shown in FIG. 19 in the first rotational direction (in the direction of the arrow DM shown in FIG. 19) around the axis of the container paddle 30K (FIG. 20B).

Consequently, the toner discharge port 30P moves away from the secured container shutter 32 to a supply position shown in FIG. 22B. The posture of the toner container 30 shown in FIGS. 21 and 22A and 22B is defined as a first posture of the present disclosure. In the first posture, the toner discharge port 30P of the toner container 30 communicates with the toner supply port 204 of the developing device 20 (FIG. 22B) to allow supply of toner to the developing device 20.

In the rotation of the toner container 30 from the insertion posture shown in FIG. 19 in the first rotational direction (in the DM direction), the elastic piece pushing portions 306 of the container body 31 having pushed the distal ends (FIG. 14B) of the elastic pieces 32B5 of the shutter stopper 32B move away from the elastic pieces 32B5. Therefore, when the toner discharge port 30P is exposed, the elastic pieces 32B5 are prevented from continuously receiving a strong force and, in turn, prevented from plastic deformation.

Further, when the toner container 30 is not mounted in the container mounting section 20H, the main unit shutter 22 covers the toner supply port 204. As mentioned above, when the toner container 30 is rotated in the first rotational direction to change from the insertion posture to the supply posture, the container shutter pushing pieces 305S (FIG. 12) of the toner container 30 push the main unit shutter 22 in the first rotational direction against the biasing force of the shutter springs 208 (FIG. 5). This causes the main unit shutter 22 to slide in the first rotational direction with the rotation of the container body 31 of the toner container 30 so that the toner supply port 204 is exposed as shown in FIG. 22B. Consequently, the toner discharge port 30P and the toner supply port 204 vertically communicate with each other.

The toner container 30 is mounted into the container mounting section 20H in the insertion posture as shown in FIG. 19, with the locking contact piece 202S coming into contact with the second lock engaging portion 313 as shown in FIG. 20A. Thereafter, the toner container 30 is rotated in the first rotational direction by the user, with the locking contact piece 202S rubbing against the second lock engaging piece 313 and consequently moving away from the second lock engaging piece 313. Thereafter, the locking contact piece 202S rubs against an oblique surface 312A of the first lock engaging portion 312 and subsequently engages with the first lock engaging portion 312 at a position under the first lock engaging portion 312, as shown in FIG. 22A. Consequently, the locking contact piece 202S locks the toner container 30 in the supply posture (FIG. 22B). In this locked state, even though the biasing force of the shutter springs 208 (FIG. 5) acts on the container shutter pushing portions 305 of the toner container 30 via the main unit shutter 22, rotation of the toner container 30 is restricted by the locking contact piece 202S. Thus, the toner container 30 is prevented from rotating in the second rotational direction, i.e. changing from the supply posture to the insertion posture.

On the other hand, when an unillustrated sensor detects that the toner container 30 is empty of toner, an indication for replacement of the toner container 30 is presented on an unillustrated display of the printer 100. The user pushes the lock button 202 (FIG. 18A) to move the locking contact piece 202S backward along the guide opening 201V (FIG. 18B). As a result, the locking contact piece 202S moves backward away from the first lock engaging portion 312 as indicated by the arrow DR shown in FIG. 22A, thereby disengaging from the first lock engaging portion 312. Thus, the restricting force having been exerted on the first lock engaging portion 312 is lost, and the locking of the toner container 30 is released. Because the main unit shutter 22 receives the biasing force of the shutter springs 208, the main unit shutter 22 pushes the container shutter pushing portions 305 of the toner container 30 to thereby move the toner container 30 in the second rotational direction (in the direction of the arrow DN shown in FIG. 21). Consequently, the toner container 30 automatically changes from the supply posture to the insertion posture owing to the biasing force of the shutter springs 208. In the rotation of the toner container 30 in the second rotational direction, the locking contact piece 202S is biased by the oblique surface 312A of the first lock engaging portion 312 owing to the biasing force of the lock biasing spring 201U. When the first lock engaging portion 312 moves away from the locking contact piece 202S, the locking contact piece 202S returns to the position shown in FIG. 18A.

In the posture change of the toner container 30, the toner discharge port 30P moves in the second rotational direction to be covered again by the container shutter 32 in the insertion posture. In addition, the main unit shutter 22 slides owing to the biasing force of the shutter springs 208 so that the toner supply port 204 is covered again by the main unit shutter 22.

The toner container 30 having returned to the insertion posture shown in FIG. 19 is dismounted from the container mounting section 20H in the dismounting direction, thereby being dismounted from the developing device 20. In this manner, in the present embodiment, the user only needs to push the lock button 202 to release the locking of the toner container 30 so that the toner container 30 changes into the insertion posture. At this time, the toner discharge port 30P and the toner supply port 204 are covered by the container shutter 32 and the main unit shutter 22, respectively. This makes it possible to prevent the area around the developing device 20 and the toner container 30 from getting stained with toner when the user dismounts the toner container 30 from the developing device 20.

<Mounting and Dismounting of Developing Device 20 and Toner Container 30>

In the above-described manner, in the present embodiment, the developing unit 120H including the developing device 20 and the toner container 30 is mounted in and dismounted from the casing 101. In addition, the developing device 20 can also be independently mounted in and dismounted from the casing 101, and the toner container 30 can be mounted on and dismounted from the developing device 20 mounted in the casing 101.

With reference to FIG. 1, in the open state of the front cover 106, the developing device 20 is mounted onto the developing position facing the photoconductive drum 121 through an insertion path DH defined in the main body internal space 107. On the other hand, in the open state of the front cover 106, the toner container 30 can be mounted into the container mounting section 20H of the developing device 20 through the insertion path DH. In the dismounting of the developing device 20 from the casing 101, the developing device 20 is rotated in a first direction (in the arrow DR2 direction shown in FIG. 1) around the axis (first axis) of the developing roller 21A by the lock lever 50. Consequently, the developing device 20 moves to the standby position from the developing position to be subsequently dismounted from the casing 101 through the insertion path DH. On the other hand, the toner container 30 is, in a state that the front cover 106 is open and the developing device 20 is at the developing position or the standby position, rotated in a second direction (in the direction of the arrow DN shown in FIG. 1) around the rotary axis (second axis) of the container paddle 30K in the container mounting section 20H. Thereafter, the toner container 30 is dismounted from the casing 101 through the insertion path DH.

In this manner, in the present embodiment, the developing device 20 and the toner container 30 are mounted in and dismounted from the casing 101 through the common insertion path DH in the open state of the front cover 106. Further, the toner container 30 can be dismounted from the container mounting section 20H, regardless of whether the developing device 20 is at the developing position or the standby position. This allows improvement in the operability for the user in the mounting and the dismounting of the developing device 20 and the toner container 30.

Further, the first direction (the arrow DR2 direction shown in FIG. 1) in which the developing device 20 is rotated from the developing position to the standby position to be dismounted is opposite to the second direction (the arrow DN direction shown in FIG. 1) in which the toner container 30 is rotated to be dismounted. Therefore, there is no need to rotate the toner container 30 further in the first direction after the developing device 20 is rotated from the developing position in the first direction. Accordingly, the space to be prepared at the downstream side of the developing device 20 in the first direction for the mounting and dismounting operations can be reduced. In particular, in the present embodiment, the frame front wall 100H1 is vertically disposed downstream of the developing unit 120H in the first direction. The frame front wall 100H1 constitutes a part of the support frame 100H1 supporting the exposure device 123 and prevents entrance of light into the exposure device 123 when the front cover 106 is opened or closed. As shown in FIG. 2, the distance between the toner container 30 and the frame front wall 100H1 is made as small as possible, which reduces the size of the printer 100 in the forward/backward direction. As described above, the toner container 30 is rotated, not in the first direction, but in the second direction (in the arrow DN direction shown in FIG. 1) to be dismounted. Therefore, the fingers of the user holding the toner container 30 are prevented from entering deep into the space between the toner container 30 and the frame front wall 100H1. This further improves the operability in the dismounting of the toner container 30.

Further, in the present embodiment, the developing device 20 is rotated in the first direction around the rotary axis of the developing roller 21A, thereby moving from the developing position to the standby position. This can prevent reduction in the space between the developing roller 21A and the photoconductive drum 121 in the dismounting of the developing device 20, which, in turn, prevents damage of the developing roller 21A and the photoconductive drum 121. In the case where the developing device 20 includes the contact roller 211 as in the present embodiment, the above-mentioned advantageous effect is reliably enhanced.

Further, in the present embodiment, in the mounting and the dismounting of the toner container 30, the toner container 30 is rotated around the rotary axis of the container paddle 30K. Therefore, the toner container 30 can be made to rotate with the circumferential surface passing along a smaller track. Consequently, the printer 100 can be made further compact.

The printer 100 including the toner container 30 and the developing device 20 according to the embodiment of the present disclosure has been described. The described configuration provides a printer 100 which realizes the improved operability in the mounting and the dismounting of the developing device 20 and the toner container 30 into and from the casing 101. The present disclosure is not limited to the described configuration and, for example, the following modified embodiments may be adopted.

(1) In the above-described embodiment, the developing device 20 includes the lock lever 50. However, the present disclosure is not limited to this configuration. The developing device 20 may be configured to be rotated from the developing position to the standby position and then dismounted from the casing 101 by the user.

(2) In the above-described embodiment, the developing device 20 is rotated around the rotary axis of the developing roller 21A, and the toner container 30 is rotated around the rotary axis of the container paddle 30K. However, the present disclosure is not limited to this configuration. The developing device 20 and the toner container 30 may each be configured to rotate around another axis set at a different position.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. An image forming apparatus, comprising:

an apparatus body including an openable cover member and an internal space;

an image carrier rotatably disposed in the apparatus body and having a circumferential surface for allowing an electrostatic latent image to be formed thereon; and a developing device including a developer supply port for receiving supplied developer and a mounting section, the developing device being configured to be mounted, in an open state of the cover member, onto a developing position facing the image carrier through a specific insertion path in the internal space, and supply the developer to the image carrier; and a developer container including a developer discharge port for discharging the developer, and being configured to be mounted, in the open state of the cover member, onto the mounting section of the developing device through the insertion path, and contain the developer, the developer container is configured to be changeable between a first posture in which the developer discharge port communicates with the developer supply port to supply the developer to the developing device and a second posture in which the developer discharge port is at a distance from the developer supply port and covered in the mounting section, wherein the developing device is configured to be dismounted from the apparatus body through the insertion path after being rotated, in the open state of the cover member, from the developing position to a standby position in a first direction around a first axis extending in parallel with a rotary axis of the image carrier, the developer container is configured to be disengaged from the developing device and dismounted from the apparatus body through the insertion path after being rotated, in a state that the cover member is open and the developing device is at the developing position or the standby position, in a second direction opposite to the first direction around a second axis extending in parallel with the first axis in the mounting section, and the developer container is rotated around the second axis from the first posture to the second posture.

2. An image forming apparatus according to claim 1, wherein the developing device includes a developing roller which faces the image carrier, and is rotatable, and supplies the developer to the image carrier at the developing position, and the first axis coincides with a rotary axis of the developing roller.

3. An image forming apparatus according to claim 1, wherein the developer container includes:

a container body in the form of a cylinder extending in an axial direction of the second axis; and a stirring member which is disposed in the container body, and is rotatable, and stirs the developer contained in the container body, and the second axis coincides with a rotary axis of the stirring member.

4. An image forming apparatus, comprising:

an apparatus body including an openable cover member and an internal space;

an image carrier rotatably disposed in the apparatus body and having a circumferential surface for allowing an electrostatic latent image to be formed thereon; and a developing device including a developer supply port for receiving supplied developer and a mounting section, the developing device being configured to be mounted, in an open state of the cover member, onto a developing position facing the image carrier through a specific insertion path in the internal space, and supply the developer to the image carrier; and a developer container including a developer discharge port for discharging the developer, and being configured to be mounted, in the open state of the cover member, onto the mounting section of the developing device through the insertion path, and contain the developer, wherein the developing device is configured to be dismounted from the apparatus body through the insertion path after being rotated, in the open state of the cover member, from the developing position to a standby position in a first direction around a first axis extending in parallel with a rotary axis of the image carrier; and the developer container is configured to be disengaged from the developing device and dismounted from the apparatus body through the insertion path after being rotated, in a state that the cover member is open and the developing device is at the developing position or the standby position, in a second direction opposite to the first direction around a second axis extending in parallel with the first axis in the mounting section;

the image forming apparatus further comprising:

a guide section disposed in the apparatus body and configured to guide the mounting and the dismounting of the developing device;

a positioning mechanism disposed in the guide section, and including a biasing member and a contact portion operable to come into contact with the developing device, the positioning mechanism being configured to bias the developing device mounted on the developing position toward the image carrier to thereby position the developing device; and a lever member pivotally disposed in the developing device, and configured to be changeable between a locking posture of locking the developing device at the developing position and a release posture of releasing the locking of the developing device to move the developing device from the developing position to the standby position in the apparatus body.

5. An image forming apparatus according to claim 4, wherein the developing device includes a developing roller which faces the image carrier, and is rotatable, and supplies the developer to the image carrier at the developing position, and the first axis coincides with a rotary axis of the developing roller.

6. An image forming apparatus according to claim 4, wherein the developer container includes:

a container body in the form of a cylinder extending in an axial direction of the second axis; and a stirring member which is disposed in the container body, and is rotatable, and stirs the developer contained in the container body, and the second axis coincides with a rotary axis of the stirring member.

* * * * *